US012520933B2

(12) United States Patent
Choi

(10) Patent No.: US 12,520,933 B2
(45) Date of Patent: Jan. 13, 2026

(54) STABLE AND CONVENIENT FOLDABLE FRAME AND TABLE

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 95 days.

(21) Appl. No.: 18/498,526

(22) Filed: Oct. 31, 2023

(65) Prior Publication Data

US 2024/0358147 A1 Oct. 31, 2024

(30) Foreign Application Priority Data

Apr. 25, 2023 (CN) ..... 202320964500.1
Apr. 25, 2023 (CN) ..... 202320964532.1
Apr. 25, 2023 (CN) ..... 202320965448.1

(51) Int. Cl.
*A47B 3/087* (2006.01)

(52) U.S. Cl.
CPC ..... *A47B 3/087* (2013.01)

(58) Field of Classification Search
CPC ..... A47B 3/087; A47B 2003/0835
See application file for complete search history.

(56) References Cited

U.S. PATENT DOCUMENTS 737,455 A 8/1903 Noble
922,179 A 5/1909 Nolan
1,063,642 A 6/1913 Birdsell
1,911,750 A 5/1933 Collignon
2,136,569 A 11/1938 Trimpi
2,325,182 A 7/1943 Fitzpatrick
2,730,418 A 1/1956 Blink
2,766,089 A 10/1956 Nielsen
2,803,033 A 8/1957 Rachman
2,803,050 A 8/1957 Birger Fernberg
2,811,400 A 10/1957 James
2,868,599 A 1/1959 Roggio
3,075,809 A 1/1963 Wilson
(Continued)

FOREIGN PATENT DOCUMENTS

CA 2971886 A1 12/2018
CN 207048532 U * 2/2018
(Continued)

*Primary Examiner* — Matthew W Ing
(74) *Attorney, Agent, or Firm* — MORGAN, LEWIS & BOCKIUS LLP

(57) ABSTRACT

A foldable structure includes an elongated shaft having at least one non-circular portion. The foldable structure also includes a first mounting assembly with a proximal side fixedly connected to the shaft to restrict rotation of the first mounting assembly relative to the shaft and a second mounting assembly with a proximal side rotatably connected to the shaft to allow rotation of the second mounting assembly relative to the shaft. A first panel is fixedly connected to the first mounting assembly, and a second panel is fixedly connected to the second mounting assembly. The at least one non-circular portion of the shaft has an upper surface that remains in contact with a proximal side of the first panel, and when the foldable structure is unfolded, abuts upwardly against the proximal sides of the first and second panels to help to level the first and second panels.

19 Claims, 28 Drawing Sheets

(56) References Cited

U.S. PATENT DOCUMENTS

| | | | | |
|---|---|---|---|---|
| 3,080,834 | A | 3/1963 | Risdall | |
| 3,140,674 | A | 7/1964 | Cisler | |
| 3,187,373 | A | 6/1965 | Fisher | |
| 3,276,815 | A | 10/1966 | Ernest | |
| 3,304,891 | A | 2/1967 | Rachman | |
| 3,368,504 | A | 2/1968 | Cohen | |
| 3,410,232 | A | 11/1968 | Bills | |
| 3,410,327 | A | 11/1968 | Ausnit | |
| 3,574,393 | A | 4/1971 | Hughes | |
| 3,861,328 | A | 1/1975 | Lawless | |
| 4,191,111 | A | 3/1980 | Emmert | |
| 4,285,105 | A | 8/1981 | Kirkpatrick | |
| 4,489,661 | A | 12/1984 | Fitzgerald | |
| 4,561,108 | A | 12/1985 | Kamp | |
| 4,792,240 | A | 12/1988 | Ausnit | |
| 5,325,794 | A | 7/1994 | Hontani | |
| 5,483,710 | A | 1/1996 | Chan | |
| 5,745,954 | A | 5/1998 | Shogan | |
| 5,857,229 | A | 1/1999 | Magnani, Jr. | |
| 5,921,623 | A | 7/1999 | Nye | |
| 6,192,809 | B1 * | 2/2001 | Riach | A47B 3/087 108/115 |
| 6,223,366 | B1 | 5/2001 | Cheng | |
| 6,347,831 | B1 | 2/2002 | Nye | |
| 6,363,550 | B1 | 4/2002 | Wang | |
| 6,508,262 | B1 | 1/2003 | Takayama | |
| 6,644,734 | B1 | 11/2003 | Tseng | |
| 6,752,091 | B2 | 6/2004 | Glover | |
| 6,843,183 | B2 | 1/2005 | Strong | |
| 6,971,321 | B1 | 12/2005 | Strong | |
| 7,059,254 | B2 | 6/2006 | Strong et al. | |
| 7,096,799 | B2 | 8/2006 | Strong et al. | |
| 7,097,380 | B2 | 8/2006 | Lee | |
| 7,171,910 | B2 | 2/2007 | Neunzert et al. | |
| 7,260,871 | B2 | 8/2007 | Borchardt | |
| 7,428,872 | B2 | 9/2008 | Strong et al. | |
| 7,475,643 | B2 | 1/2009 | Haney et al. | |
| 7,475,644 | B2 | 1/2009 | Strong et al. | |
| 7,634,969 | B2 | 12/2009 | Neunzert et al. | |
| 7,640,870 | B2 | 1/2010 | Strong et al. | |
| 7,644,667 | B2 | 1/2010 | Strong et al. | |
| 7,735,431 | B2 | 6/2010 | Neunzert et al. | |
| 7,874,303 | B2 | 1/2011 | Xie | |
| 8,006,630 | B2 | 8/2011 | Strong et al. | |
| 8,033,228 | B2 | 10/2011 | Haney et al. | |
| 8,042,475 | B2 | 10/2011 | Larcom et al. | |
| 8,113,130 | B2 | 2/2012 | Leng | |
| 8,132,517 | B2 | 3/2012 | Leng | |
| 8,156,875 | B2 | 4/2012 | Neunzert et al. | |
| 8,166,894 | B1 | 5/2012 | Branch | |
| 8,302,541 | B2 | 11/2012 | Haney et al. | |
| 8,342,107 | B2 | 1/2013 | Mover et al. | |
| 8,534,205 | B1 | 9/2013 | Johnson et al. | |
| 8,578,865 | B2 | 11/2013 | Haney et al. | |
| 8,622,007 | B2 | 1/2014 | Peery et al. | |
| 8,746,155 | B2 | 6/2014 | Haney et al. | |
| 8,757,069 | B2 | 6/2014 | Peery et al. | |
| 8,904,943 | B2 | 12/2014 | Jin | |
| 9,027,952 | B2 | 5/2015 | Zhu | |
| 9,103,368 | B2 | 8/2015 | Mendes | |
| D748,418 | S | 2/2016 | Johnson et al. | |
| 9,277,808 | B2 | 3/2016 | Cai et al. | |
| 9,282,812 | B2 | 3/2016 | Chang | |
| D756,694 | S | 5/2016 | Johnson et al. | |
| 9,351,563 | B2 | 5/2016 | Bennett et al. | |
| 9,462,880 | B1 | 10/2016 | Lin | |
| 10,159,334 | B1 | 12/2018 | Wang | |
| 10,206,496 | B1 | 2/2019 | Miller | |
| 10,470,561 | B2 | 11/2019 | Clegg et al. | |
| 10,602,852 | B2 | 3/2020 | Choi | |
| D895,345 | S | 9/2020 | Leng | |
| 10,806,246 | B1 | 10/2020 | Chen | |
| 10,863,819 | B1 * | 12/2020 | Chen | A47B 3/087 |
| 2003/0089286 | A1 | 5/2003 | Wang | |
| 2004/0070235 | A1 | 4/2004 | Gregory | |
| 2004/0187091 | A1 | 9/2004 | Zhurong | |
| 2004/0195869 | A1 | 10/2004 | Zhurong | |
| 2004/0227382 | A1 | 11/2004 | Lin | |
| 2005/0005826 | A1 | 1/2005 | Strong | |
| 2005/0097829 | A1 | 5/2005 | Seo | |
| 2005/0120923 | A1 | 6/2005 | Sagol | |
| 2005/0241550 | A1 | 11/2005 | Neunzert | |
| 2005/0279260 | A1 | 12/2005 | Stanford | |
| 2006/0062632 | A1 | 3/2006 | Jang | |
| 2006/0181114 | A1 | 8/2006 | Nye | |
| 2006/0196395 | A1 | 9/2006 | Lin | |
| 2007/0079441 | A1 | 4/2007 | Chen | |
| 2007/0101910 | A1 | 5/2007 | Haimoff | |
| 2008/0018142 | A1 | 1/2008 | Yul | |
| 2008/0078310 | A1 | 4/2008 | VanNimwegen | |
| 2009/0293779 | A1 * | 12/2009 | Leng | A47B 3/0913 108/132 |
| 2013/0000528 | A1 | 1/2013 | Jin | |
| 2013/0025507 | A1 | 1/2013 | Jin | |
| 2013/0025509 | A1 | 1/2013 | Jin | |
| 2013/0233210 | A1 | 9/2013 | Jin | |
| 2014/0030012 | A1 | 1/2014 | Lee | |
| 2014/0070070 | A1 | 3/2014 | Shinoda | |
| 2014/0099155 | A1 | 4/2014 | Chen | |
| 2014/0130837 | A1 | 5/2014 | Sy-Facunda | |
| 2014/0345506 | A1 * | 11/2014 | Clegg | A47B 3/087 108/169 |
| 2016/0227919 | A1 | 8/2016 | Turner | |
| 2016/0348395 | A1 | 12/2016 | Jin | |
| 2017/0013955 | A1 | 1/2017 | Lin | |
| 2017/0340100 | A1 | 11/2017 | Tsai | |
| 2018/0153302 | A1 | 6/2018 | Jiang | |
| 2019/0150608 | A1 | 5/2019 | Johnson et al. | |
| 2019/0284831 | A1 | 9/2019 | Volin | |
| 2019/0292808 | A1 | 9/2019 | Dotterweich | |
| 2020/0029684 | A1 | 1/2020 | Jiang | |
| 2020/0390233 | A1 | 12/2020 | Leng | |
| 2021/0106132 | A1 | 4/2021 | Chen | |
| 2021/0112967 | A1 | 4/2021 | Leng | |
| 2021/0112968 | A1 | 4/2021 | Ponomar | |
| 2021/0177135 | A1 | 6/2021 | Leng | |
| 2021/0222823 | A1 | 7/2021 | Choi | |
| 2021/0274929 | A1 | 9/2021 | Choi | |
| 2021/0274930 | A1 | 9/2021 | Choi | |
| 2021/0345776 | A1 | 11/2021 | Choi | |

FOREIGN PATENT DOCUMENTS

| | | | |
|---|---|---|---|
| CN | 109431070 | A | 3/2019 |
| DE | 4321853 | A1 | 1/1995 |
| DE | 29515948 | U1 | 1/1996 |
| EP | 1492432 | B1 | 10/2016 |
| GB | 2192534 | A | 1/1988 |
| WO | WO 2011097404 | A1 | 8/2011 |
| WO | WO 2013000149 | A1 | 1/2013 |

* cited by examiner

STABLE AND CONVENIENT FOLDABLE FRAME AND TABLE

CROSS-REFERENCE TO RELATED APPLICATIONS

The present application claims priority to Chinese Applications CN 202320964500.1 filed Apr. 25, 2023, CN 202320964532.1 filed Apr. 25, 2023, and CN 202320965448.1 filed Apr. 25, 2023. The disclosure of each application is incorporated herein for all purposes by reference in its entirety.

FIELD OF THE INVENTION

The present invention generally relates to frames and tables, in particular, to convenient foldable frames and tables with enhanced stability.

BACKGROUND

Foldable tables are popular because they require less storage space and are easy to carry around. An existing foldable table generally includes two panels coupled to a supporting frame having two or more foldable legs. However, many exiting foldable tables are not easy to use, and in some cases, are not stable or reliable.

Given the current state of the art, there remains a need for frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable structures, such as frames and tables, that are more stable and more convenient to use.

In various exemplary embodiments, the present disclosure provides a foldable structure including a shaft, a first mounting assembly, a second mounting assembly, a first panel and a second panel. The shaft is elongated in a first direction and includes at least one non-circular portion. The first mounting assembly has a proximal side fixedly connected to the shaft to restrict rotation of the first mounting assembly relative to the shaft. The second mounting assembly has a proximal side rotatably connected to the shaft to allow rotation of the second mounting assembly relative to the shaft. The first panel is fixedly connected to the first mounting assembly, and the second panel fixedly connected to the second mounting assembly. An upper surface of the at least one non-circular portion of the shaft remains in contact with a proximal side of the first panel, and when the foldable structure is unfolded, abuts upwardly against the proximal sides of the first and second panels, thereby helping to level the first and second panels.

In some exemplary embodiments, the at least one non-circular portion of the shaft has a substantially "D"-shaped cross section.

In some exemplary embodiments, the upper surface of the at least one non-circular portion of the shaft is substantially flat, and substantially parallel to an upper surface of the first panel.

In some exemplary embodiments, the shaft is non-circular along substantially an entire length of the shaft.

In some exemplary embodiments, the at least one non-circular portion includes a non-circular end portion of the shaft. In some such embodiments, the first mounting assembly includes a first mounting member and the second mounting assembly includes a second mounting member. A proximal end portion of the first mounting member includes a non-circular hole to receive the non-circular end portion of the shaft. The non-circular hole of the first mounting member is sized and shaped corresponding to the non-circular end portion of the shaft to restrict the first mounting assembly together with the first panel from rotating relative to the shaft. A proximal end portion of the second mounting member includes a substantially round hole to receive the non-circular end portion of the shaft and to allow the mounting second assembly together with the second panel to rotate relative to the shaft.

In some exemplary embodiments, the proximal end portion of the first mounting member includes a first lug integrally formed or coupled with the first mounting member, and the proximal end portion of the second mounting member includes a second lug integrally formed or coupled with the second mounting member.

In some exemplary embodiments, the foldable structure further includes a coupler disposed at the end portion of the shaft. The coupler is movable relative to the shaft in a height direction of the foldable structure to automatically engage the second mounting member with the first mounting member when the foldable structure is unfolded and in use, thereby preventing accidental folding of the second mounting assembly relative to the first mounting assembly.

In some exemplary embodiments, the proximal end portion of the first mounting member includes a first slot, and the proximal end portion of the second mounting member includes a second slot. The first and second slots are aligned with each other in a height direction of the foldable structure when the foldable structure is unfolded. At least one of the first and second slots has a closed bottom and an open top. The coupler includes a first coupling piece with a third slot to receive the shaft and a second coupling piece integrally formed or coupled with the first coupling piece. The third slot has a closed bottom and a closed top, with a dimension in the height direction of the foldable structure larger than the shaft to allow the first coupling piece to move relative to the shaft in the height direction of the foldable structure, thereby selectively disposing the second coupling piece in the first and second slots to lock the first and second mounting members with each other or removing the second coupling piece from the at least one of the first and second slots to unlock the first and second mounting members from each other.

In some exemplary embodiments, the foldable structure further includes a first connector, a second connector, or both of the first and second connectors. The first connector is connected to the shaft and fixedly connected to the proximal side of the first panel. The second connector is rotatably connected to the shaft and fixedly connected to the proximal side of the second panel.

In some exemplary embodiments, the first or second connector is sleeved on the shaft.

In some exemplary embodiments, the first or second connector is elongated along a length direction of the shaft.

In some exemplary embodiments, the first connector includes a first surface that remains in contact with the proximal side of the first panel, and when the foldable structure is unfolded, abuts upwardly against the proximal sides of the first and second panels, thereby helping to level the first and second panels. In some exemplary embodiments, the second connector includes a second surface that remains in contact with the proximal side of the second panel, and when the foldable structure is unfolded, abuts upwardly against the proximal sides of the first and second panels, thereby helping to level the first and second panels.

In some exemplary embodiments, the first surface is substantially flat and parallel to an upper surface of the first panel. In some exemplary embodiments, the second surface is substantially flat and parallel to an upper surface of the second panel.

In some exemplary embodiments, the first surface of the first connector and the second surface of the second connector are substantially leveled with each other when the foldable structure is unfolded.

In some exemplary embodiments, the foldable structure further includes a first leg assembly, a second leg assembly, a first supporting assembly and a second supporting assembly. The first leg assembly is pivotally connected to the first mounting assembly and the second leg assembly is pivotally connected to the second mounting assembly. The first supporting assembly is configured to control rotation of the first leg assembly and the second supporting assembly is configured to control rotation of the second leg assembly. The first or second supporting assembly includes: a first supporting member pivotally connected to the first or second leg assembly, a controller coupled with the first supporting member and selectively movable along the first supporting member, and one or more second supporting members, each having a first end portion fixedly connected to the controller and a second end portion pivotally connected to the shaft.

In some exemplary embodiments, the foldable structure further includes a first connector connected to the shaft and fixedly connected to the proximal side of the first panel, and a second connector rotatably connected to the shaft and fixedly connected to the proximal side of the second panel. The first or second connector includes at least one slot to receive the second end portion of each of the one or more second supporting members.

In various exemplary embodiments, the present disclosure provides a foldable structure including a shaft, a first mounting assembly, a second mounting assembly, a first panel, a second panel, a first connector and a second connector. The shaft is elongated in a first direction. The first mounting assembly has a proximal side fixedly connected to the shaft to restrict rotation of the first mounting assembly relative to the shaft. The second mounting assembly has a proximal side rotatably connected to the shaft to allow rotation of the second mounting assembly relative to the shaft. The first panel fixedly connected to the first mounting assembly, and the second panel is fixedly connected to the second mounting assembly. The first connector is disposed at the shaft and fixedly connected to the first panel. The first connector includes a first surface that remains in contact with the proximal side of the first panel, and when the foldable structure is unfolded, abuts upwardly against the proximal sides of the first and second panels, thereby helping to level the first and second panels. The second connector is disposed at the shaft and fixedly connected to the first panel. The second connector is rotatable relative to the shaft and includes a second surface that remains in contact with the proximal side of the second panel, and when the foldable structure is unfolded, abuts upwardly against the proximal sides of the first and second panels, thereby helping to level the first and second panels.

In various exemplary embodiments, the present disclosure provides a foldable structure including a shaft, a first mounting assembly and a second mounting assembly. The shaft is elongated in a first direction and including at least one non-circular portion. The first mounting assembly includes one or more non-circular holes at a proximal side thereof. The one or more non-circular holes correspond to the at least one non-circular portion of the shaft to couple the first mounting assembly with the shaft and to restrict the first mounting assembly from rotating relative to the shaft. The second mounting assembly includes one or more substantially round holes at a proximal side thereof to couple the second mounting assembly with the shaft and to allow the second mounting assembly to rotate relative to the shaft.

In some exemplary embodiments, the at least one non-circular portion includes a first non-circular end portion and a second non-circular end portion. the first mounting assembly includes a pair of first mounting members and the second mounting assembly includes a pair of second mounting members. Each respective first mounting member includes one or more first lugs at a proximal end portion of the respective first mounting member and a corresponding non-circular hole formed at each of the one or more first lugs to receive the first or second non-circular end portion of the shaft and to restrict the respective first mounting member from rotating relative to the shaft. Each respective second mounting member includes one or more second lugs at a proximal end portion of the respective second mounting member and a corresponding substantially round hole formed at each of the one or more second lugs to receive the first or second non-circular end portion of the shaft and to allow the respective second mounting member to rotate relative to the shaft.

In some exemplary embodiments, each respective first mounting member includes a pair of first lugs, and each respective second mounting member includes a pair of second lugs. The pair of first lugs is disposed at least partially between the pair of second lugs, or vice versa.

The foldable structures of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
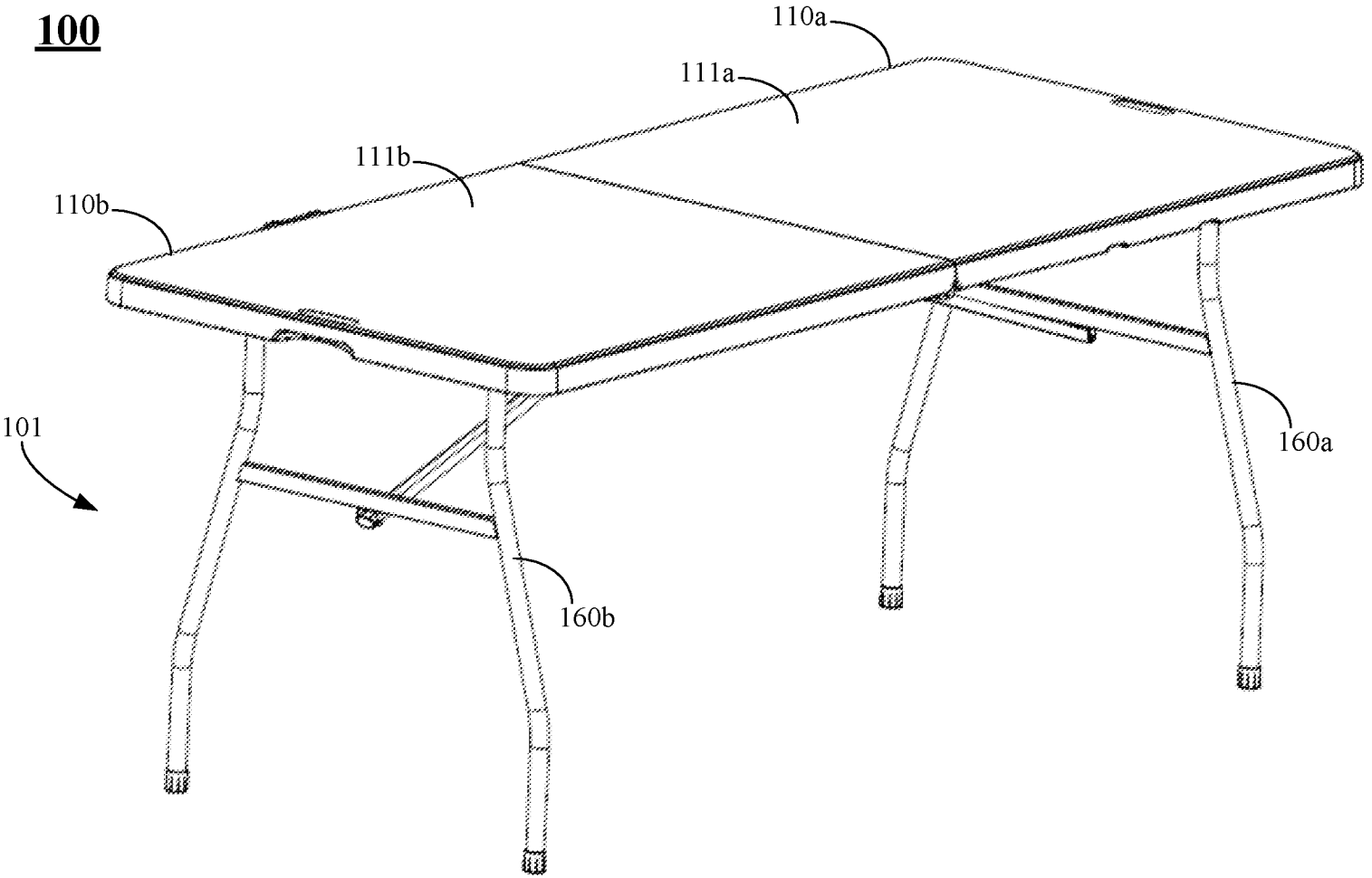
FIG. 1 is a top perspective view schematically illustrating an exemplary foldable table in an unfolded state in accordance with some exemplary embodiments of the present disclosure.
Figure 2:
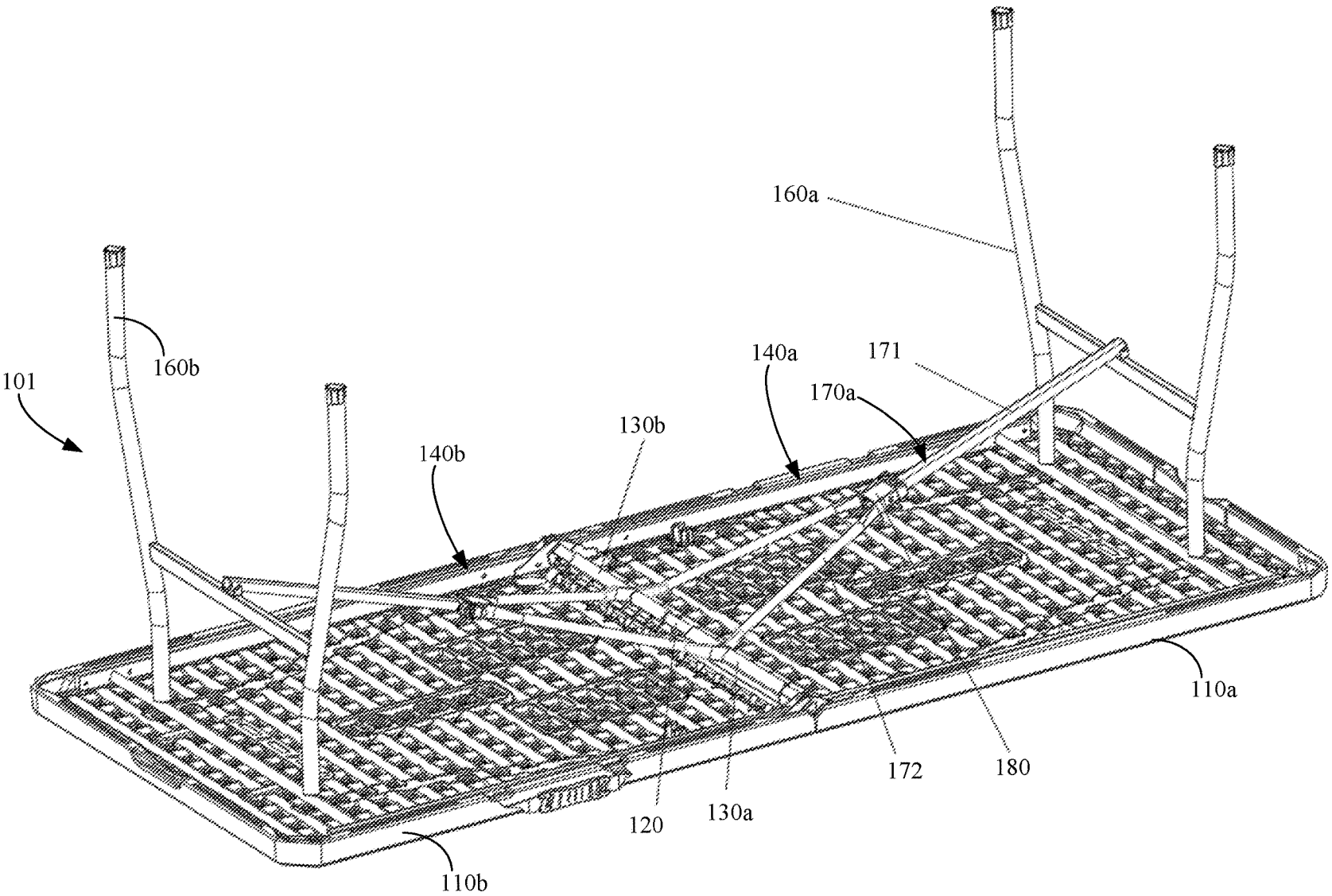
FIG. 2 is a bottom perspective view schematically illustrating the exemplary foldable table of FIG. 1 in accordance with some exemplary embodiments of the present disclosure.
Figure 3:
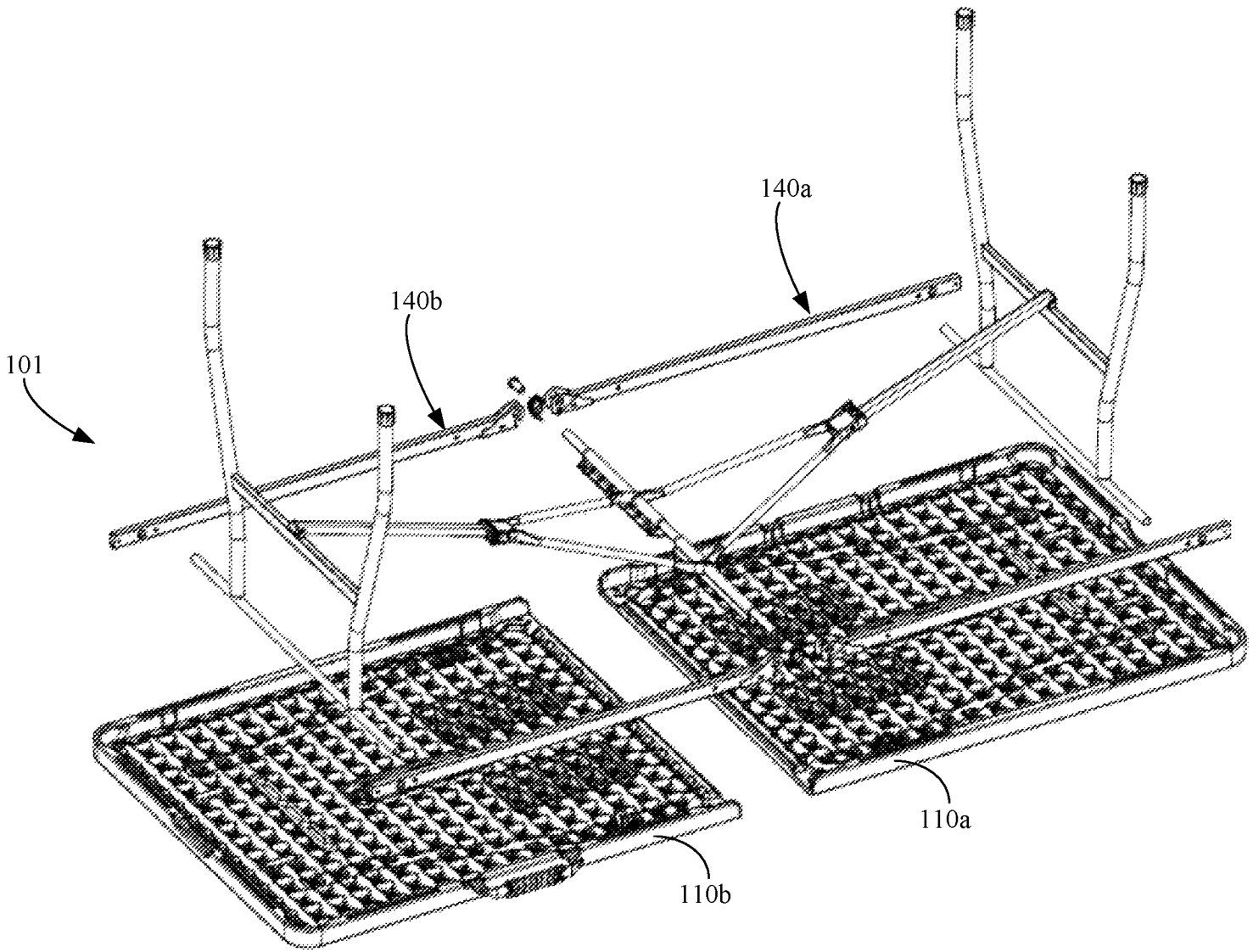
FIG. 3 is a bottom perspective and partially disassembled view schematically illustrating the exemplary foldable table of FIG. 1 in accordance with some exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable structures. A foldable structure generally includes a shaft, a first unit and a second unit. The first unit includes a first panel and the second unit includes a second panel. The first unit is fixedly connected to the shaft and is prevented from rotating relative to the shaft. The second unit is rotatably connected to the shaft and is allowed to rotate relative to the shaft so that the second unit can be folded and unfolded relative to the first unit. In various exemplary embodiments, the shaft is elongated and has at least one portion that is non-circular (e.g., having a non-circular cross section). The non-circular portion of the shaft has an upper surface that remains in contact with a proximal side of the first panel, and when the foldable structure is unfolded, abuts upwardly against the proximal sides of both the first and second panels. In some exemplary embodiments, the foldable structure includes a first connector disposed at the shaft and fixedly connected to the first panel. The first connector has a first surface that remains in contact with the proximal side of the first panel, and when the foldable structure is unfolded, abuts upwardly against the proximal sides of the first and second panels. In some exemplary embodiments, the foldable structure includes a second connector disposed at the shaft and fixedly connected to the second panel. The second connector second surface that remains in contact with the proximal side of the second panel, and when the foldable structure is unfolded, abuts upwardly against the proximal sides of the first and second panels. As such, the shaft, first connector, and/or second connector help to level the first and second panels, e.g., help supporting the first and second panels or preventing the proximal sides of the first and second panels from warping, sagging, dislocation or misalignment, or any combination thereof.

A portable structure of the present disclosure can be any suitable furniture, compliance, system or the like, including but not limited to tables, benches and beds. While the present disclosure shows portable structures in the form of a foldable table or a foldable table frame, it should be noted that this is a non-limiting example and that the components disclosed herein can be applied readily in other portable structures. The structures can be made of various materials including but not limited to metals (e.g., iron, steel, and aluminum), plastics and woods. In some exemplary embodiments, some components of a structure are made of metals or the like while some other components are made of plastics, rubbers or the like.

Referring now to FIGS. 1-4, there is depicted an exemplary foldable table 100 in accordance with some exemplary embodiments of the present disclosure. Foldable table 100 includes a first panel, such as first panel 110*a*, a second panel, such as second panel 110*b*, and a frame, such as frame 101, to support the first and second panels. The first and second panels can be, but do not necessarily have to be, identical or symmetric to each other. As a non-limiting example, first panel 110*a* and second panel 110*b* are illustrated to be substantially the same and disposed symmetrically with respect to each other. In some exemplary embodiments, first panel 110*a* includes a first working surface, such as working surface 111*a*, and second panel 110*b* includes a second working surface, such as working surface 110*b*. When the foldable table is unfolded and in use, the first and second working surfaces are generally facing upward.

The first and second panels can be made of various materials including but not limited to plastics and woods. In some exemplary embodiments, each of the first and second panels is a unitary piece formed by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like. The panel generally includes a first panel wall, a second panel wall and a generally hollow interior formed between the first and second panel walls. The panel can be of various regular or irregular shapes, including but not limited to a square shape, a half circular shape or a rectangular shape. The panel can have other features, such as depressions, ridges, protrusions, steps, or the like, monolithically formed with the first and/or second panel walls.

Frame 101 includes a first mounting assembly, such as first mounting assembly 140*a*, and a second mounting assembly, such as second mounting assembly 140*b*. The first panel is fixedly connected to the first mounting assembly so that the first panel moves along with first mounting assembly. Together, the first panel and first mounting assembly are collectively referred to as a first unit. Similarly, the second panel is fixedly connected to the second mounting assembly so that the second panel moves along with the second mounting assembly. Together, the second panel and second mounting assembly are collectively referred to as a second unit. When the foldable table is unfolded and in use, the first mounting assembly is generally disposed under the first panel and the second mounting assembly is generally disposed under the second panel.

A mounting assembly can include one or more mounting members. For instance, in some exemplary embodiments, first mounting assembly 140*a* includes one or more first mounting members 141*a*, and second mounting assembly 140*b* includes one or more second mounting members 141*b*. The first and second mounting members can be but do not necessarily have to be identical or symmetric to each other. In some exemplary embodiments, first mounting assembly 140*a* includes a pair of first mounting members 141*a* spaced apart generally in a first direction, e.g., the x-direction in FIG. 4. As used herein, the term "spaced apart" does not necessarily require the two components be parallel to each other, and does not necessarily require complete physical separation of the two components. Similarly, in some exemplary embodiments, second mounting assembly 140*b* includes a pair of second mounting members 141*b* spaced apart generally in the same direction as the pair of first mounting members 141*a*.

Frame 101 also includes a shaft, such as shaft 120. In various exemplary embodiments, one of the first and second mounting assemblies is fixedly connected to the shaft and the other of the first and second mounting assemblies is rotatably connected to the shaft so that the first and second mounting assemblies (and thus the first and second units) can be folded and unfolded relative to each other. For instance, in the illustrated embodiment, the first mounting assembly has its proximal side fixedly connected to the shaft such that the first unit (e.g., the first mounting assembly together with the first panel) is restricted from rotating relative to the shaft. The second mounting assembly has its proximal side rotatably connected to the shaft. This allows the second unit (e.g., the second mounting assembly together with the second panel) to rotate relative to the shaft, and consequently allows the second unit to fold and unfold relative to the first unit. As used herein, the proximal sides of the first and second mounting assemblies refer to the sides adjacent to the shaft. The distal sides of the first and second mounting assemblies refer to and the sides opposite the proximal sides. For instance, in FIG. 4, the proximal sides of the first and second mounting assemblies are in the middle of the frame. The distal sides correspond to the lower-left and upper-right sides of the figure. It should be noted that the term "middle" as used herein does not necessarily mean the center of the foldable frame or table, and the term "side" does not necessarily mean an outmost edge of the foldable frame or table.

Figure 4:
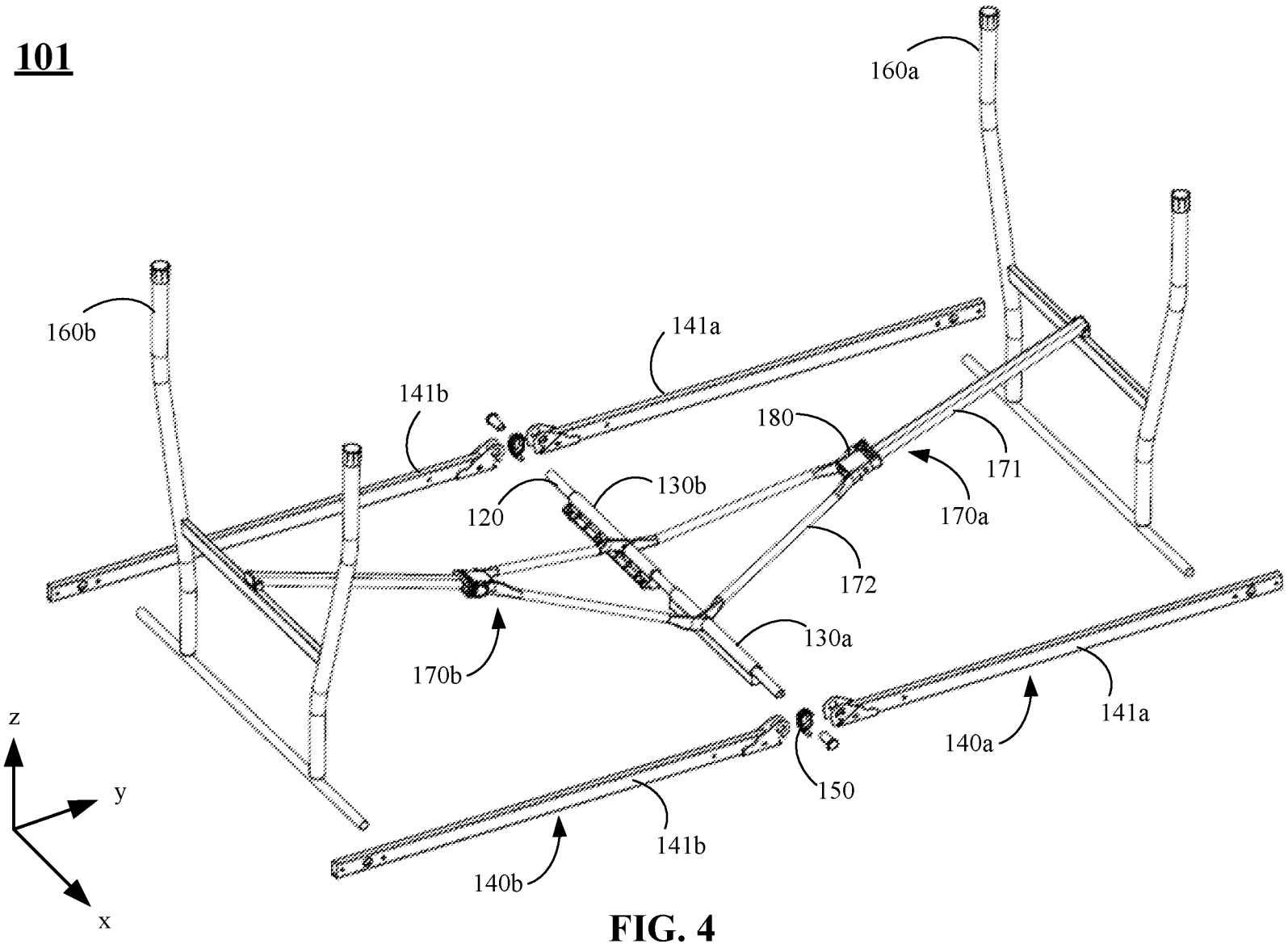
FIG. 4 is a partially disassembled view schematically illustrating an exemplary foldable flame in accordance with some exemplary embodiments of the present disclosure.
Figure 5:
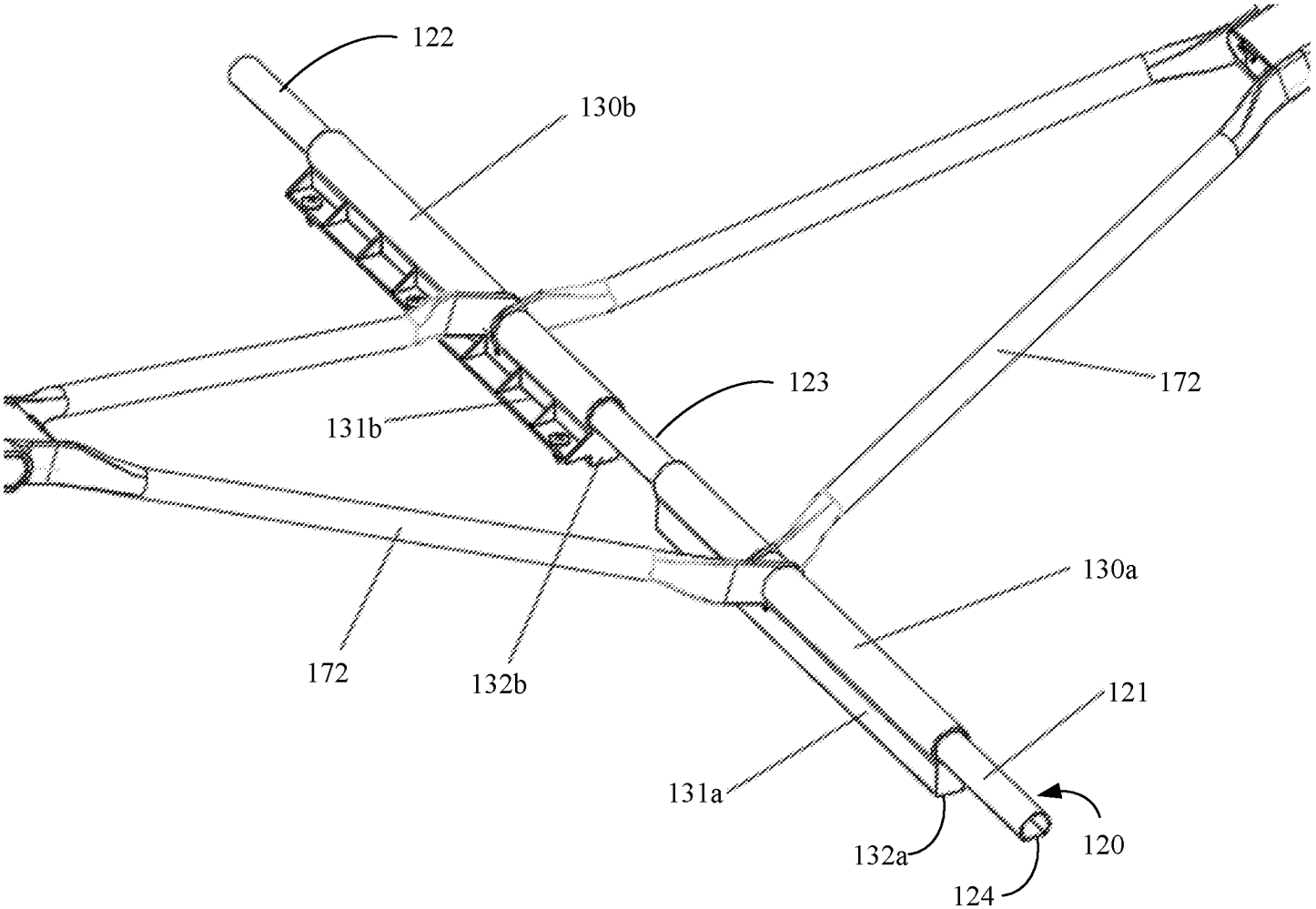
FIG. 5 is an enlarged view of a portion of the exemplary foldable frame of FIG. 4.

Referring to FIGS. 4-8, in various exemplary embodiments, shaft 120 is elongated in a first direction, e.g., the x-direction in FIG. 4. In some exemplary embodiments, shaft 120 includes multiple portions, such as first end portion 121, second end portion 122, and/or middle portion 123 between the first and second end portions. In some exemplary embodiments, at least a portion of the shaft is non-circular and configured for fixedly connecting the shaft with the first mounting assembly, for remaining in contact with the proximal side of the first panel, for abutting upwardly against the proximal sides of the first and second panels when the foldable structure is unfolded, or any combination thereof. For instance, in some exemplary embodiments, one or more of the first end portion, the second end portion and the middle portion are non-circular. In some exemplary embodiments, the shaft is non-circular along substantially its entire length.

As used herein, a non-circular portion of the shaft refers to a portion having a non-circular cross section in the y-z plane in FIG. 4. The shape of a non-circular cross section can be either regular or irregular, including but not limited to triangles, rectangles, hexagons, ovals, or "D" shape. Also, the shape or size of a non-circular portion can be but do not necessarily have to the same as the shape or size of another non-circular portion. Further, a non-circular portion can but do not necessarily have to remain in contact with a panel through the entire non-circular portion. The contact can occur at one or more distinct spots or areas. By way of example, shaft 120 is illustrated with a substantially "D"-shaped cross section along substantially its entire length. In some exemplary embodiments, a non-circular portion of the shaft includes an upper surface, such as upper surface 124. In some exemplary embodiments, the upper surface is substantially flat (e.g., the non-circular cross section including a straight edge).

In some exemplary embodiments, at least one of the first and second end portions of the shaft is non-circular and configured for fixedly connecting the shaft with the first mounting assembly. For instance, in some exemplary embodiments, first end portion 121 of the shaft is non-circular. First mounting assembly 140*a* includes first mounting member 141*a* having a non-circular hole, such as non-circular hole 143*a*, at its proximal end portion to receive the non-circular first end portion of the shaft. The non-circular hole of the first mounting member is sized and shaped corresponding to the non-circular first end portion of the shaft to restrict the first mounting assembly (together with the first panel) from rotating relative to the shaft. In some exemplary embodiments, first mounting member 141*a* of the first mounting assembly includes one or more first lugs, such as first lug 142*a*, at its proximal end portion. A first lug can be integrally formed or coupled with the proximal end portion of the first mounting member. In some such embodiments, a non-circular hole is formed at each of the one or more first lugs to receive the first non-circular end portion of the shaft and to restrict the first mounting member (and thus the first mounting assembly together with the first panel) from rotating relative to the shaft. In some exemplary embodiments, first mounting member 141*a* of the first mounting assembly includes a pair of first lugs 142*a*.

In some exemplary embodiments, each of first end portion 121 and second end portion 122 of the shaft is non-circular. First mounting assembly 140*a* includes a pair of first mounting members 141*a*, one fixedly connected to the first end portion of the shaft and the other fixedly connected to the second end portion of the shaft. In some exemplary embodiments, each first mounting member 141*a* has a non-circular hole, such as non-circular hole 143*a*, at its proximal end portion to receive the non-circular first or second end portion of the shaft. The non-circular hole of each first mounting member is sized and shaped corresponding to the non-circular first or second end portion of the shaft to restrict the first mounting assembly (together with the first panel) from rotating relative to the shaft. In some exemplary embodiments, each first mounting member 141*a* includes one or more first lugs, such as first lug 142*a*, at its proximal end portion, with the non-circular hole form on each first lug. In some exemplary embodiments, each first mounting member 141*a* of the first mounting assembly includes a pair of first lugs 142*a*.

Second mounting assembly 140*b* is rotatably connected to the shaft. For instance, in some exemplary embodiments, second mounting assembly 140*b* includes second mounting member 141*b* having a substantially circular hole, such as circular hole 143*b*, at its proximal end portion. The substantially circular hole of the second mounting member is configured to receive the first end portion of the shaft and to allow the second mounting assembly (together with the second panel) to rotate relative to the shaft. In some exemplary embodiments, second mounting member 141*b* includes one or more second lugs, such as second lug 142*b*, at its proximal end portion. A second lug can be integrally formed or coupled with the proximal end portion of the second mounting member. In some such embodiments, a substantially circular hole is formed at each of the one or more second lugs to receive the first non-circular end portion of the shaft and to allow the second mounting member (and thus the second mounting assembly together with the second panel) to rotate relative to the shaft. In some exemplary embodiments, second mounting member 141*b* includes a pair of second lugs 142*b*. In some exemplary embodiments, at least a portion of second lugs 142*b* is disposed between first lugs 142*a*, or vice versa.

In some exemplary embodiments, second mounting assembly 140*b* includes a pair of second mounting members 141*b*, one rotatably connected to the first end portion of the shaft and the other rotatably connected to the second end portion of the shaft. In some exemplary embodiments, each second mounting member 141*b* has a substantially circular hole, such as circular hole 143*b*, at its proximal end portion to receive the first or second end portion of the shaft and to allow the second mounting assembly (together with the second panel) to rotate relative to the shaft. In some exemplary embodiments, each second mounting member 141*b* includes one or more second lugs, such as second lug 142*b*, at its proximal end portion, with the substantially circular hole form on each second lug. In some exemplary embodiments, each second mounting member 141*b* includes a pair of second lugs 142*b*.

Because the second mounting assembly is rotatably connected to the shaft while the first mounting assembly is fixedly connected to the shaft, the second mounting assembly can be folded and unfolded relative to the first mounting assembly as illustrated in FIGS. 7-14. Because the first panel is fixedly connected to the first mounting assembly and the second panel is fixedly connected to the second mounting assembly, the second panel together with the second mounting assembly (e.g., the second unit) can be folded and unfolded with respect to the first panel together with the first mounting assembly (e.g., the first unit).

Figure 23:
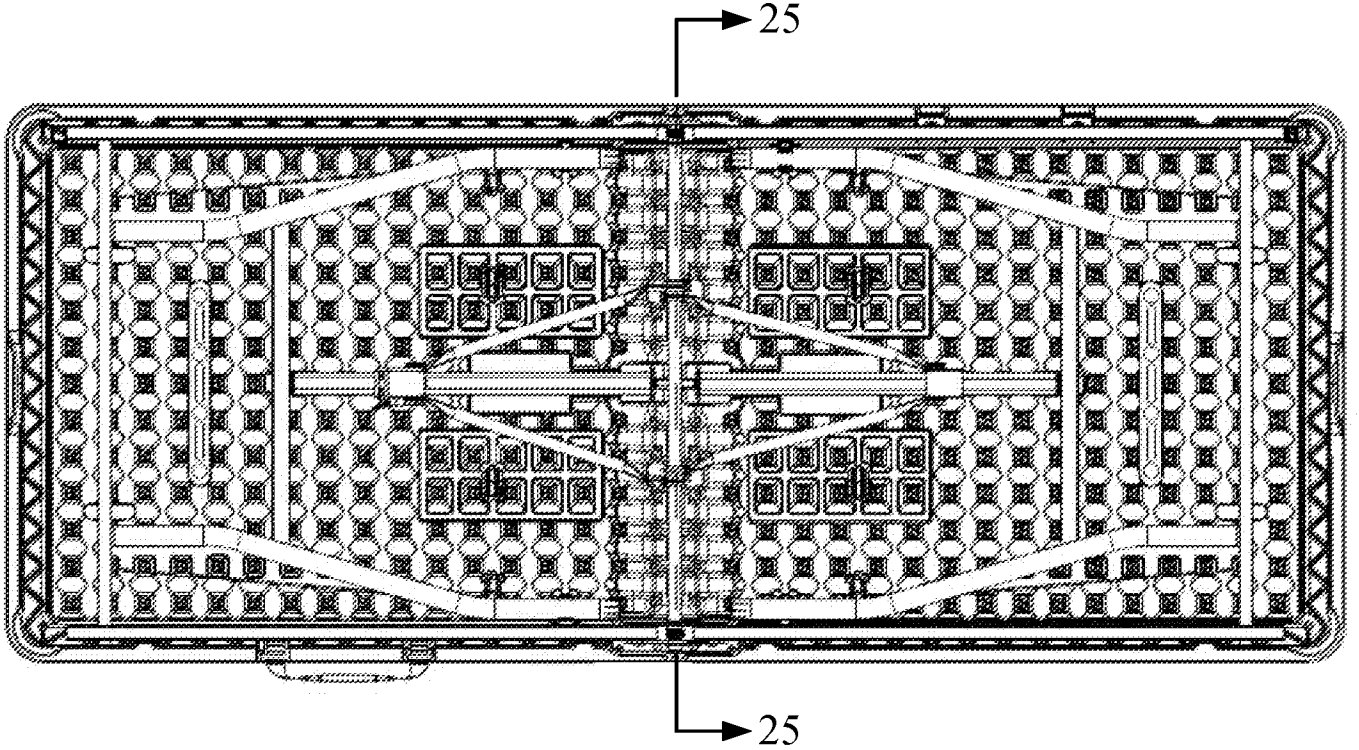
FIG. 23 is a bottom view schematically illustrating an exemplary foldable table of in an intermediate state in accordance with some exemplary embodiments of the present disclosure.
Figure 24:
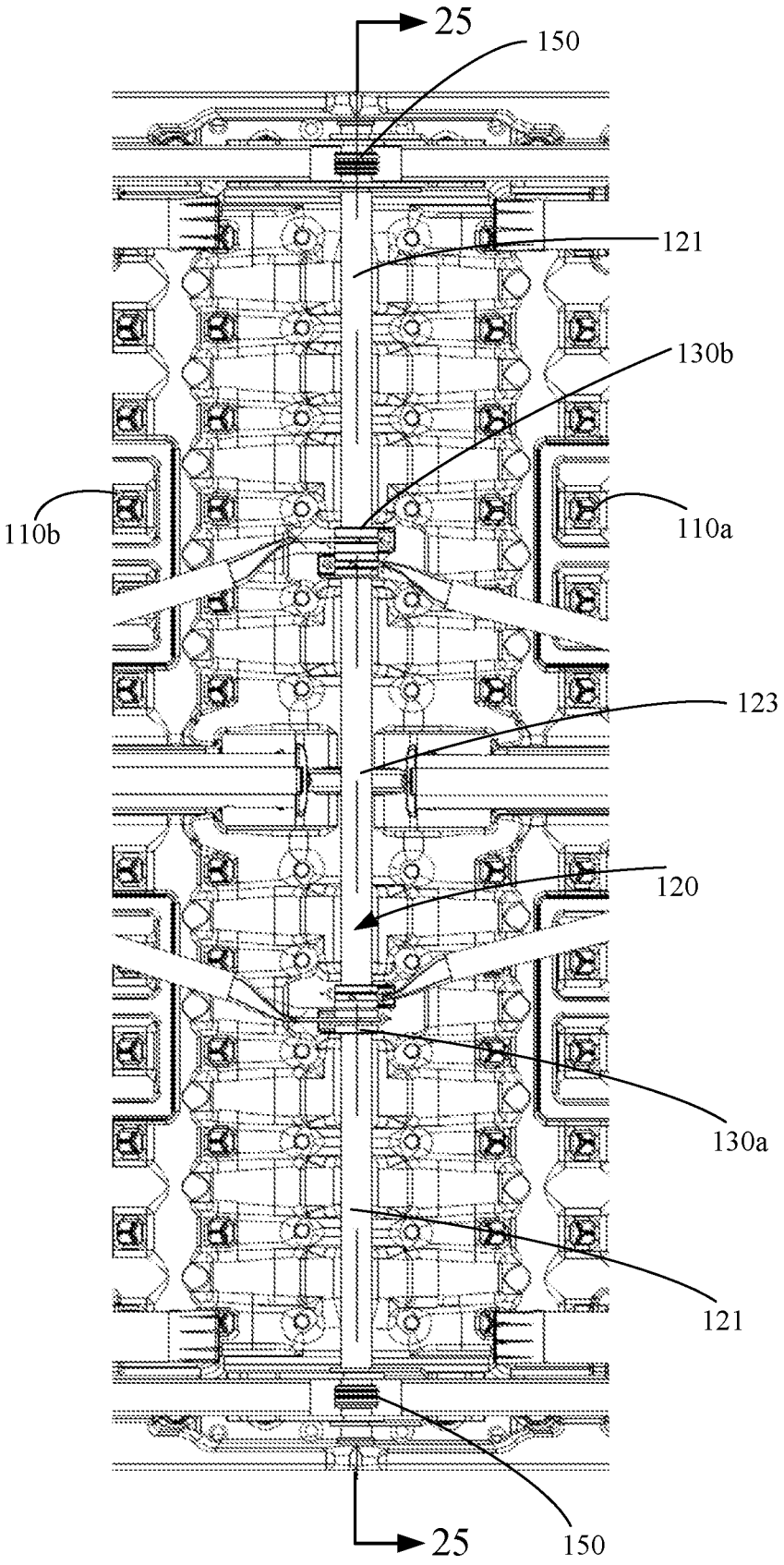
FIG. 24 is an enlarged view of a portion of FIG. 23.
Figure 25:
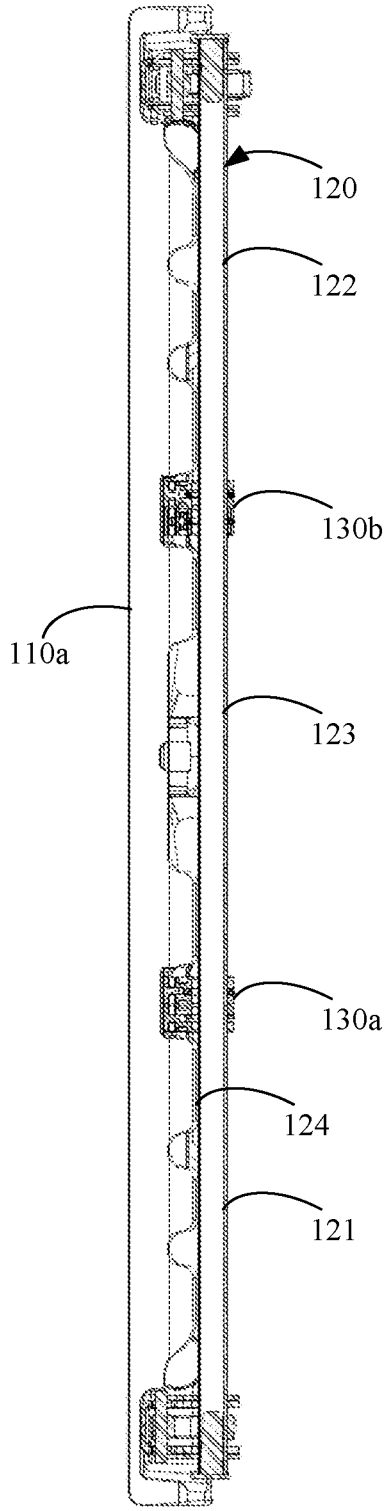
FIG. 25 is a cross-sectional view taken along line 25-25 in FIG. 24.
Figure 26:
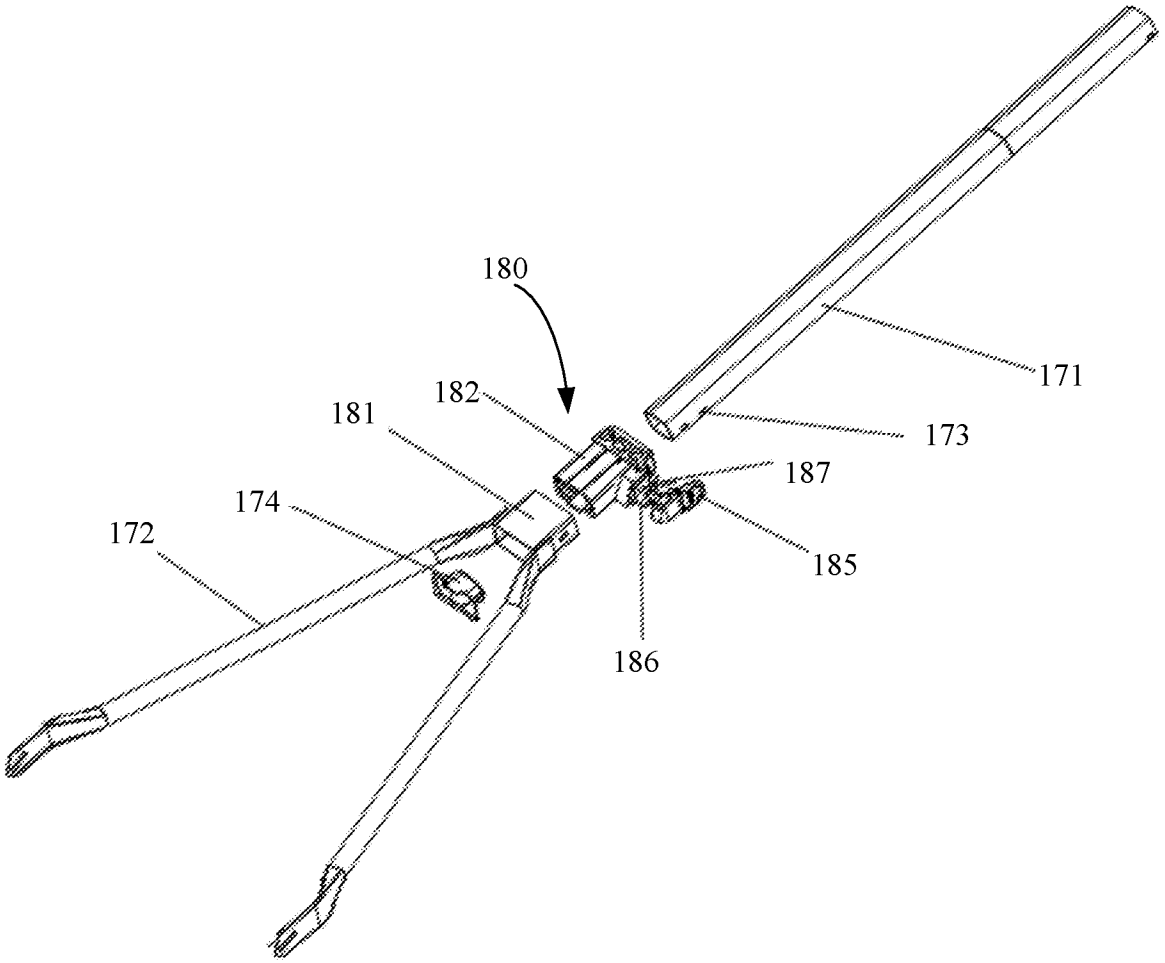
FIG. 26 is a perspective and partially disassembled view schematically illustrating an exemplary supporting assembly in accordance with some exemplary embodiments of the present disclosure.
Figure 27:
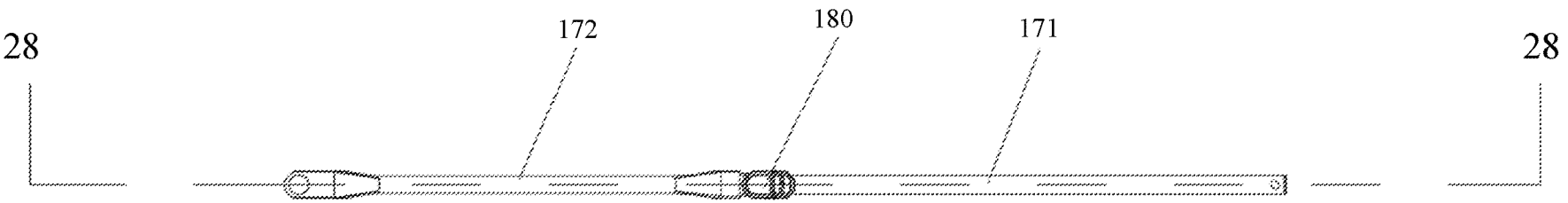
FIG. 27 is a side view schematically illustrating the exemplary supporting assembly of FIG. 26 in accordance with some exemplary embodiments of the present disclosure.
Figure 28:
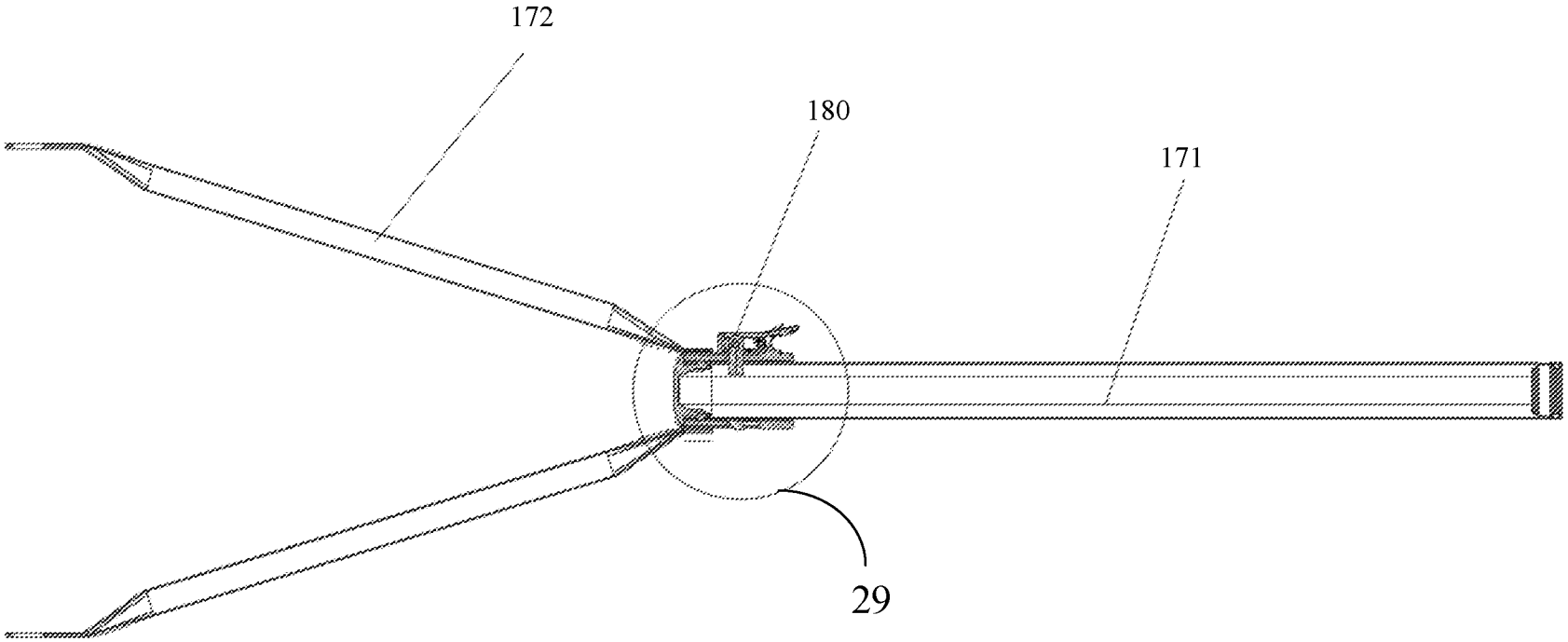
FIG. 28 is a cross-sectional view taken along line 28-28 in FIG. 27.
Figure 29:
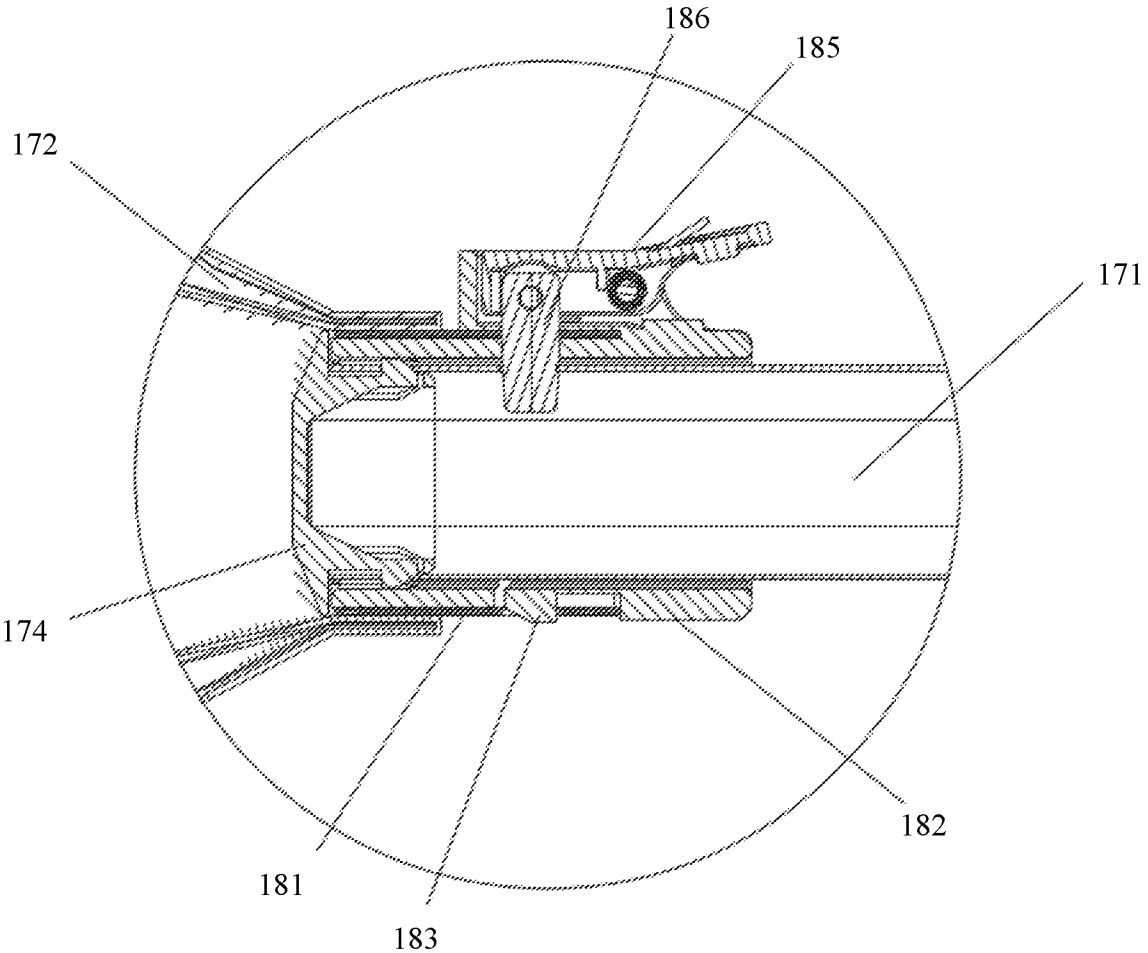
FIG. 29 is an enlarged view taken along circle 29 in FIG. 28.
Figure 30:
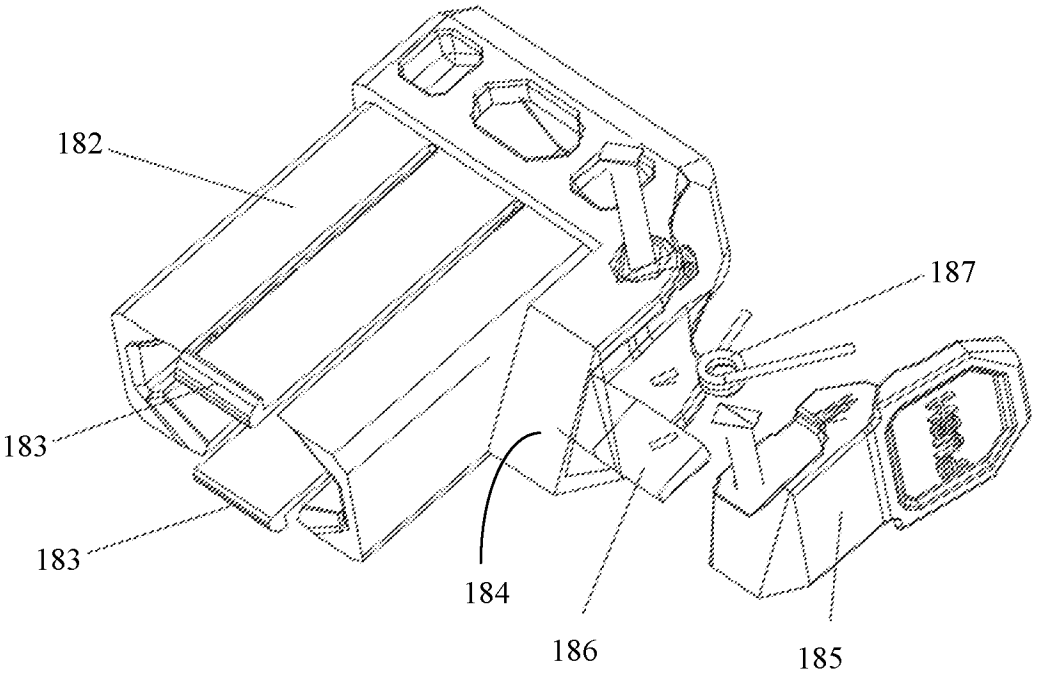
FIG. 30 is an enlarged view schematically illustrating a component of the exemplary supporting assembly of FIG. 26.
Figure 31:
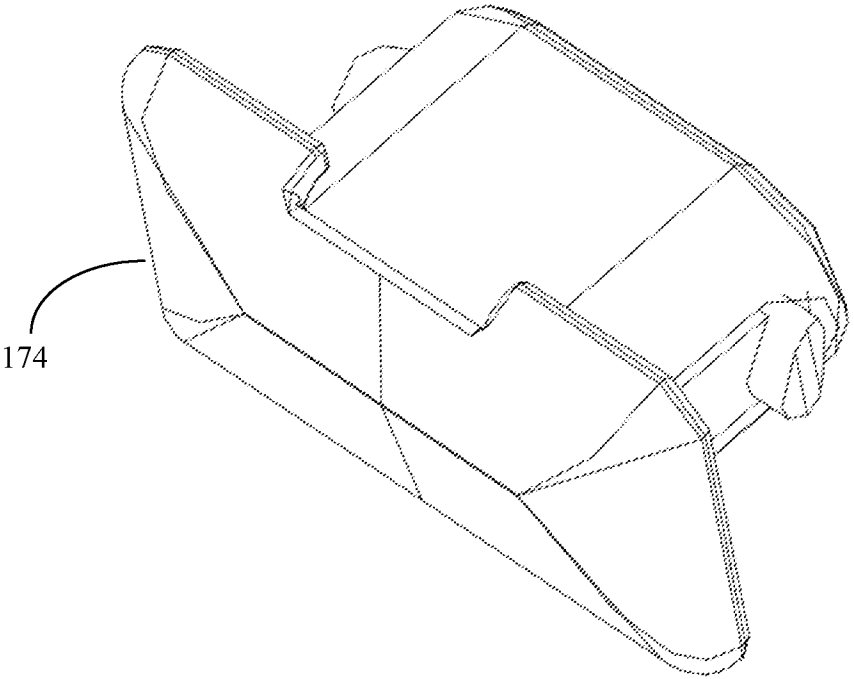
FIG. 31 is an enlarged view schematically illustrating another component of the exemplary supporting assembly of FIG. 26.

In some exemplary embodiments, at least one of the first end portion, second end portion and middle portion of the shaft is non-circular and configured for remaining in contact with the proximal side of the first panel, for abutting upwardly against the proximal sides of the first and second panels when the foldable table is unfolded, or any combination thereof. For instance, as a non-limiting example, FIGS. 23-25 illustrate that shaft 120, including first end portion 121, second end portion 122 and middle portion 123, is non-circular along substantially the entire length of the shaft with an upper surface, such as upper surface 124. The upper surface of the shaft remains in contact with the proximal side of the first panel. When the foldable table is unfolded, the upper surface of the shaft abuts upwardly against the proximal sides of the first and second panels. As such, it helps to level the first and second panels, e.g., help supporting the first and second panels and/or preventing the proximal sides of the first and second panels from warping, sagging, dislocation or misalignment. It should be noted that a surface remaining in contact with a side of a panel does not necessarily mean that the entire surface is in contact with the entire side of the panel. Contact can occur at a point, an area, or any combination thereof. Similarly, a surface abutting against a side of a panel does not necessarily mean that the entire surface abuts against the entire side of the panel.

Figure 6:
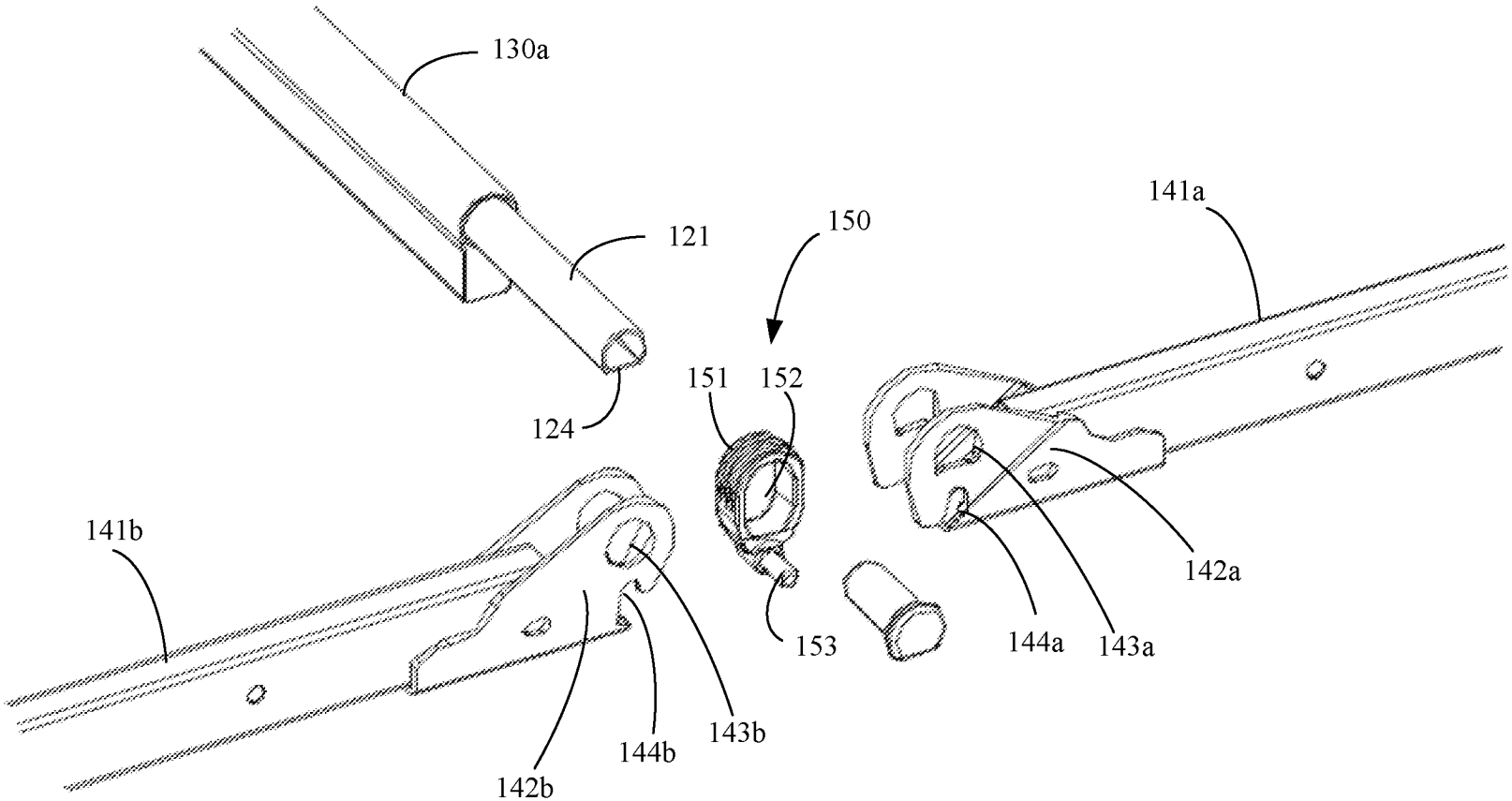
FIG. 6 is an enlarged view of another portion of the exemplary foldable frame of FIG. 4.
Figure 7:
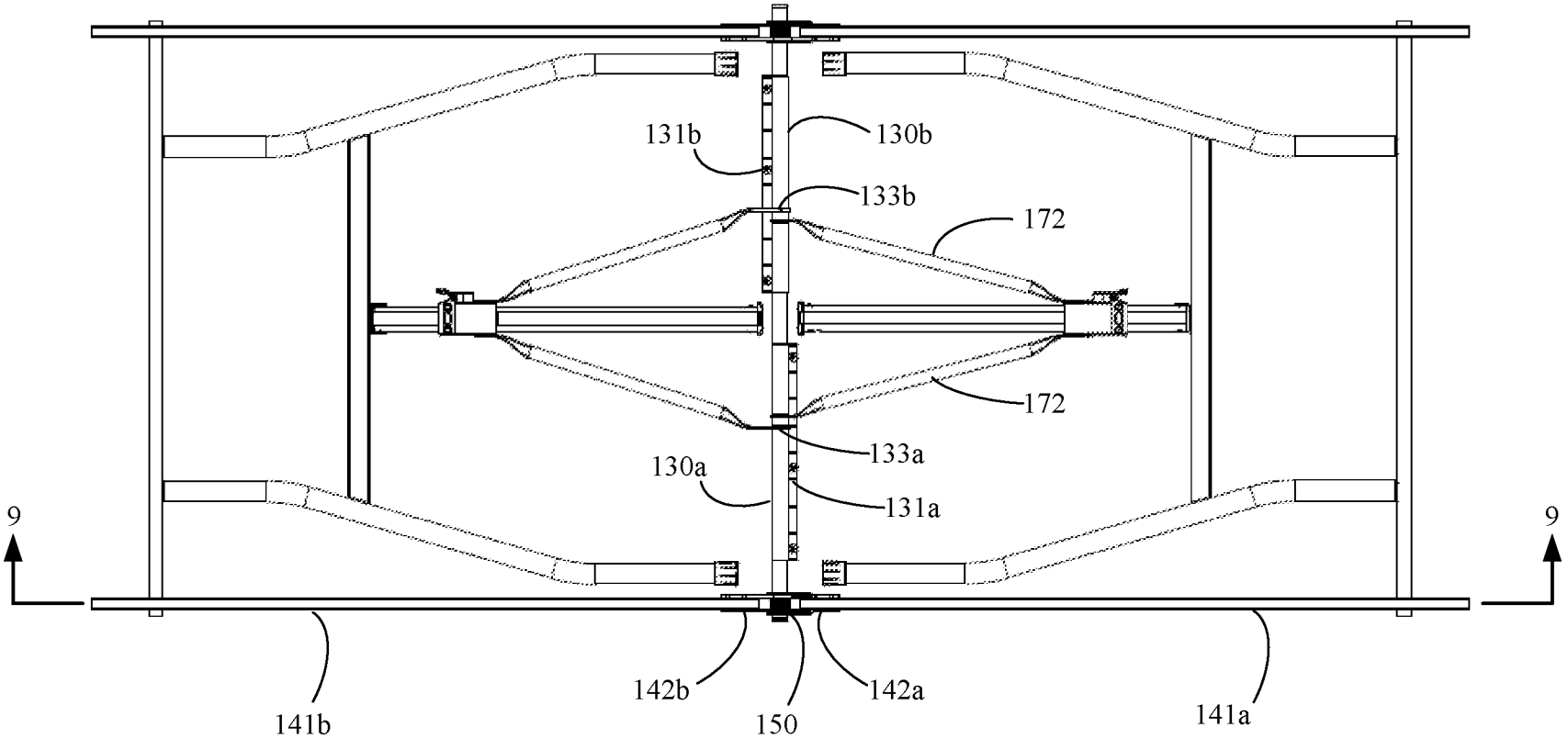
FIG. 7 is a bottom view schematically illustrating the exemplary foldable frame of FIG. 4 in an intermediate state in accordance with some exemplary embodiments of the present disclosure.
Figure 8:
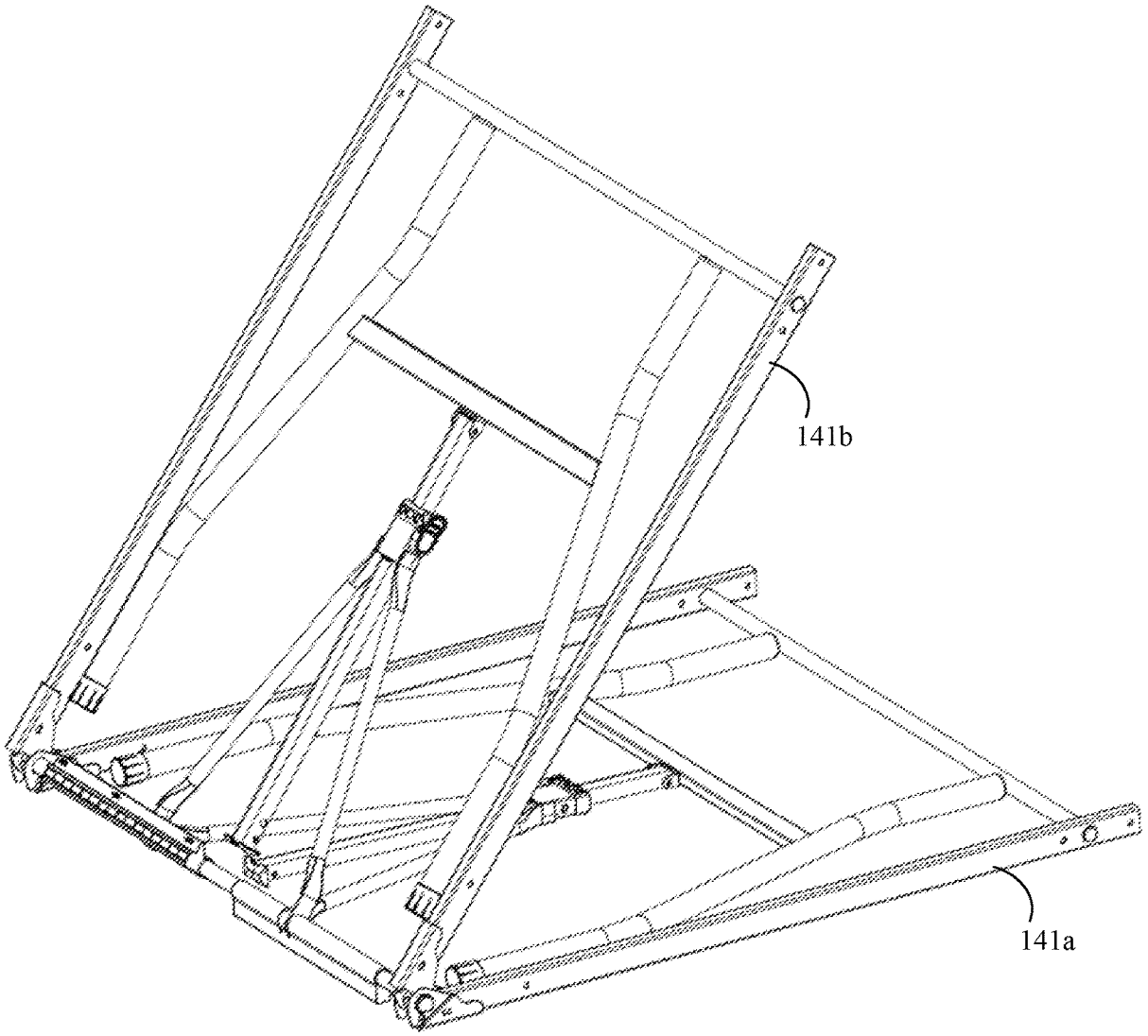
FIG. 8 is a perspective view schematically illustrating the exemplary foldable frame of FIG. 4 in another intermediate state in accordance with some exemplary embodiments of the present disclosure.
Figure 9:
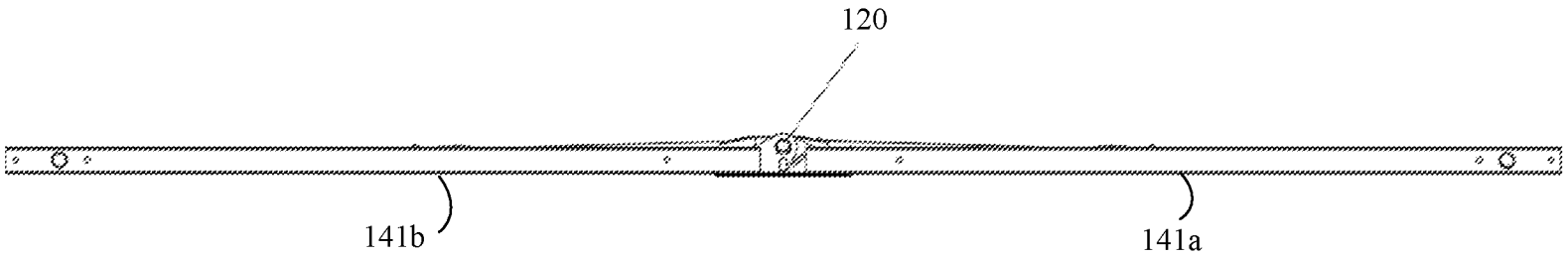
FIG. 9 is a cross-sectional view taken along line 9-9 in FIG. 7 schematically illustrating some exemplary components in a first state in accordance with some exemplary embodiments of the present disclosure.
Figure 10:
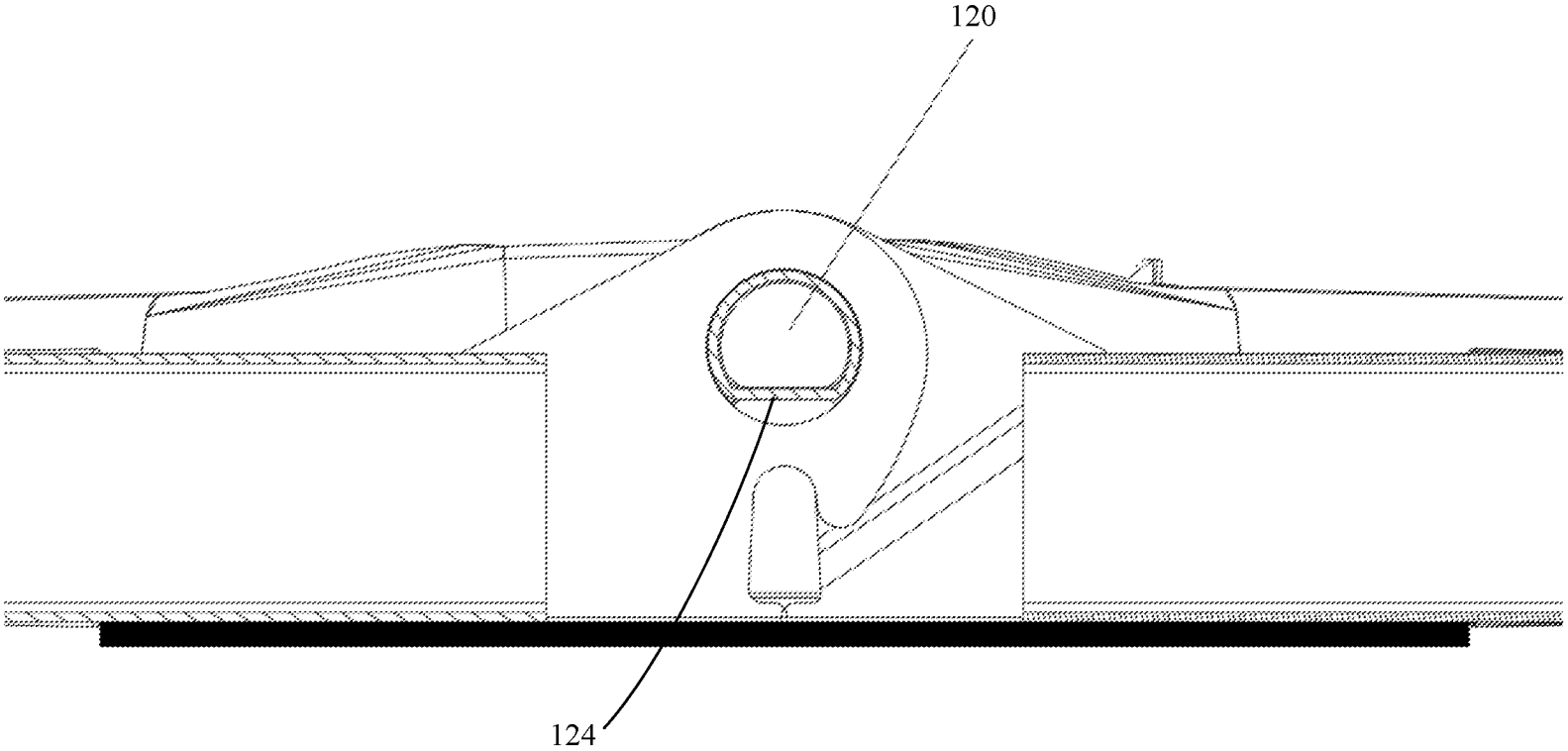
FIG. 10 is an enlarged view of a portion of FIG. 9.
Figure 11:
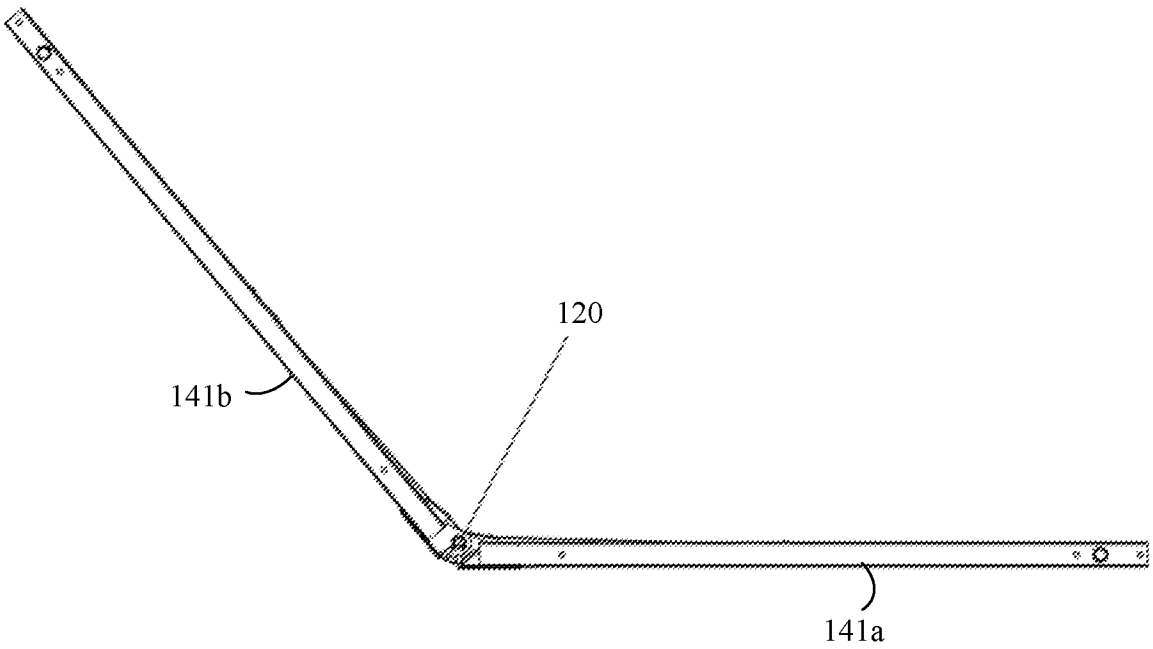
FIG. 11 is a cross-sectional view schematically illustrating the components of FIG. 9 in a second state in accordance with some exemplary embodiments of the present disclosure.
Figure 12:
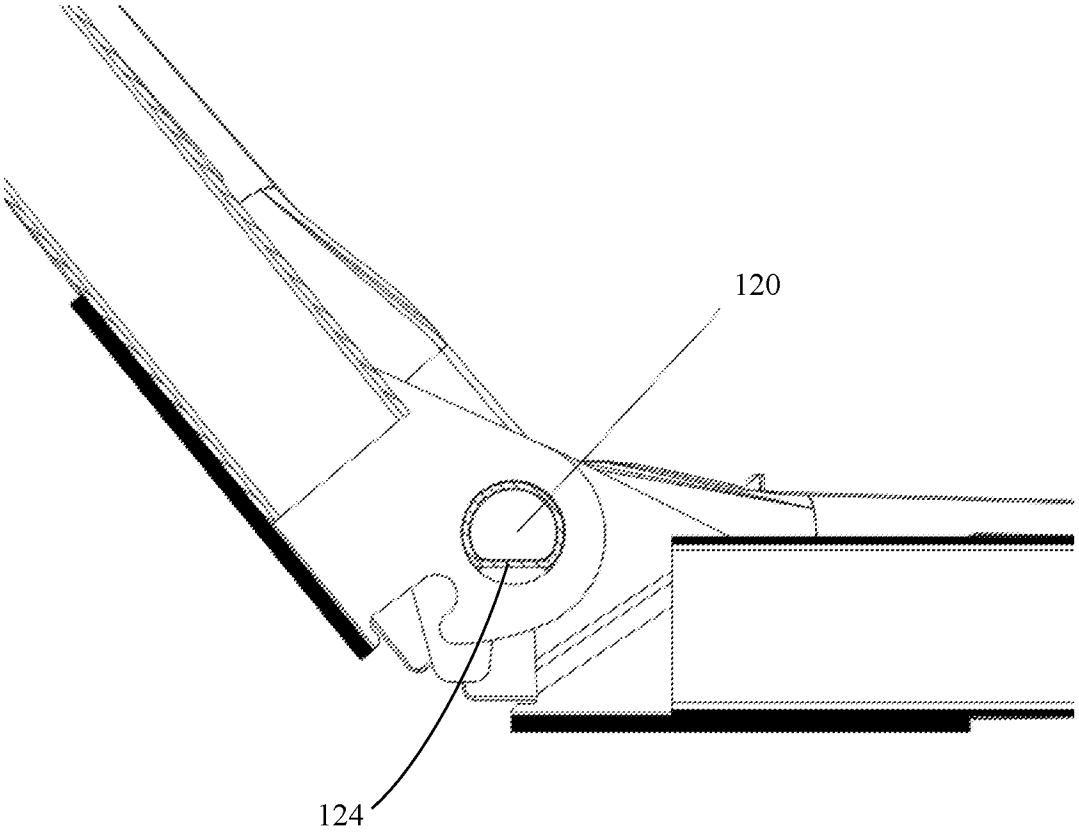
FIG. 12 is an enlarged view of a portion of FIG. 11.
Figure 13:
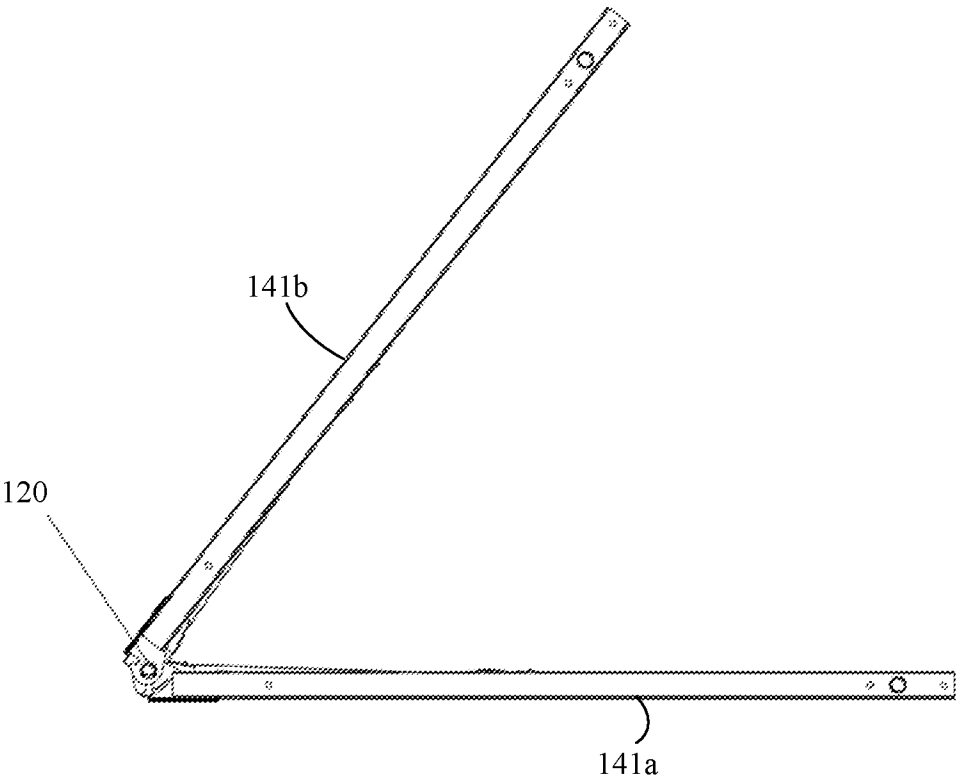
FIG. 13 is a cross-sectional view schematically illustrating the components of FIG. 9 in a third state in accordance with some exemplary embodiments of the present disclosure.
Figure 14:
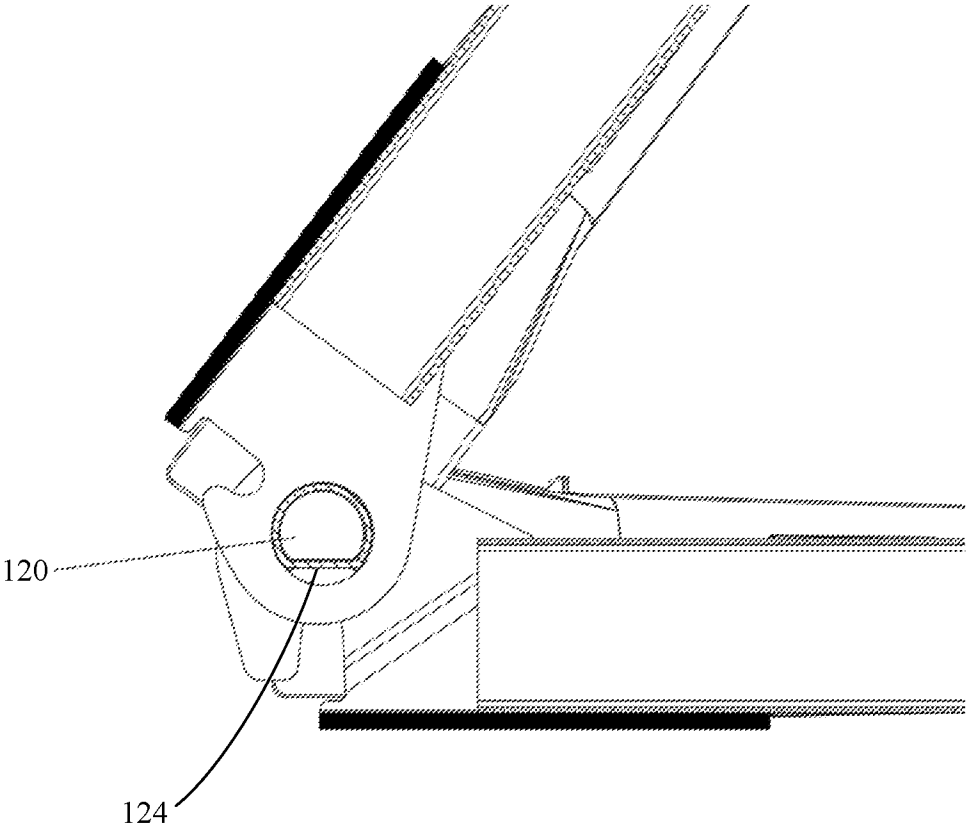
FIG. 14 is an enlarged view of a portion of FIG. 13.

Referring in FIGS. 4, 6 and 7, in some exemplary embodiments, frame 101 includes a coupler, such as coupler 150, configured for preventing accidental folding of the first and second mounting assemblies when the foldable table is in use. In some exemplary embodiments, the coupler is disposed at or connected to the shaft and is configured to automatically engage the second mounting assembly with the first mounting assembly when the foldable table is unfolded. As such, it restricts the second mounting assembly from rotating relative to the first mounting assembly, and consequently prevents accidental folding of the second unit relative to the first unit.

In some exemplary embodiments, coupler 150 is disposed at the first or second end portion of the shaft to prevent accidental folding of the second mounting assembly relative to the first mounting assembly. In some exemplary embodiments, coupler 150 is movable relative to the shaft in a height direction of the foldable table (e.g., the z-direction in FIG. 4) to automatically engage the second mounting member with the first mounting member when the foldable table is unfolded and in use (e.g., in an upright position as illustrated in FIG. 1).

For instance, in some exemplary embodiments, the proximal end portion of the first mounting member includes a first slot, such as first slot 144*a*. In some exemplary embodiments, first slot 144*a* is formed above first non-circular hole 143*a*. The proximal end portion of the second mounting member includes a second slot, such as second slot 144*b*. In some exemplary embodiments, second slot 144*b* is formed above second hole 143*b*. At least one of the first and second slots has a closed bottom and an open top. For instance, in the illustrated embodiments, second slot 144*b* has a closed bottom and an open top. The first and second slots are aligned with each other in a height direction of the foldable table when the foldable table is unfolded.

Coupler 150 includes a first coupling piece, such as first coupling piece 151. The first coupling piece includes a third slot, such as third slot 152, to receive the shaft (e.g., the end portion of the shaft can be inserted into and/or pass through the third slot). The third slot has a closed bottom and a closed top, with a dimension in the height direction of the foldable table larger than the shaft. As such, the third slot allows the first coupling piece to move relative to the shaft in the height direction of the foldable table. Coupler 150 also includes a second coupling piece, such as second coupling piece 153. The second coupling piece is integrally formed or coupled with the first coupling piece, and thus can move along with the first coupling piece relative to the shaft in the height direction of the foldable table. In some exemplary embodiments, the second coupling piece is in the form of a rod. In some exemplary embodiments, coupler 150 is configured similarly to those disclosed in U.S. patent application Ser. No. 17/368,284, the disclosure of which is incorporated herein for all purposes by reference in its entirety.

When the table is unfolded and upright, the second coupling piece moves, by gravity or other forces (e.g., manually), to the bottoms of the first and second slots. At this position, the second coupling piece engages the first and second mounting members and restricts the second mounting member from rotating with respect to the first mounting member. When the table is unfolded and upside down, the second coupling piece moves, by gravity or other forces (e.g., manually), to the tops of the first and second slots. Because the second slot has an open top, the second coupling piece releases from the second mounting member and thus allows the second mounting member to rotate with respect to the first mounting member. In some exemplary embodiments, the first slot instead of the second has an open top. In such embodiments, the second coupling piece releases from the first mounting member and again allows the second mounting member to rotate with respect to the first mounting member. In some exemplary embodiments, each of the first and second slots has an open top.

Figure 15:
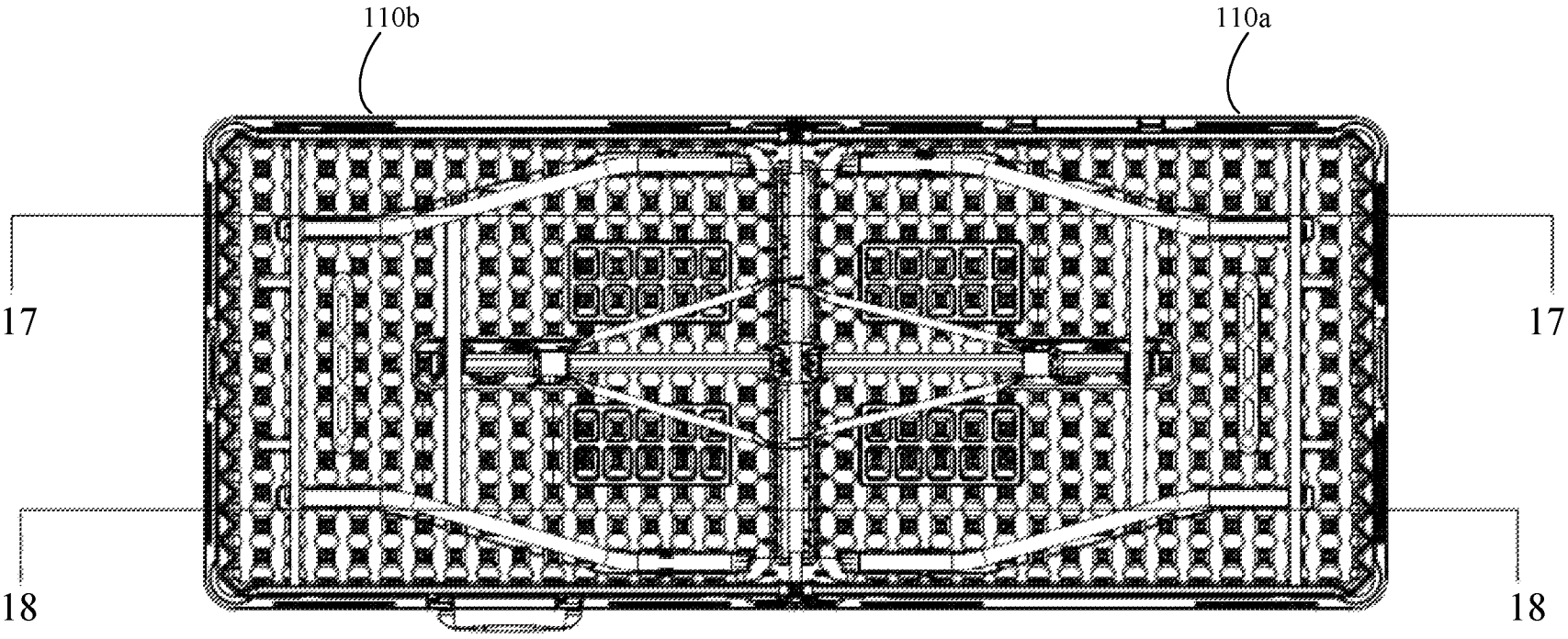
FIG. 15 is a bottom view schematically illustrating the exemplary foldable table of FIG. 1 in an intermediate state in accordance with some exemplary embodiments of the present disclosure.
Figure 16:
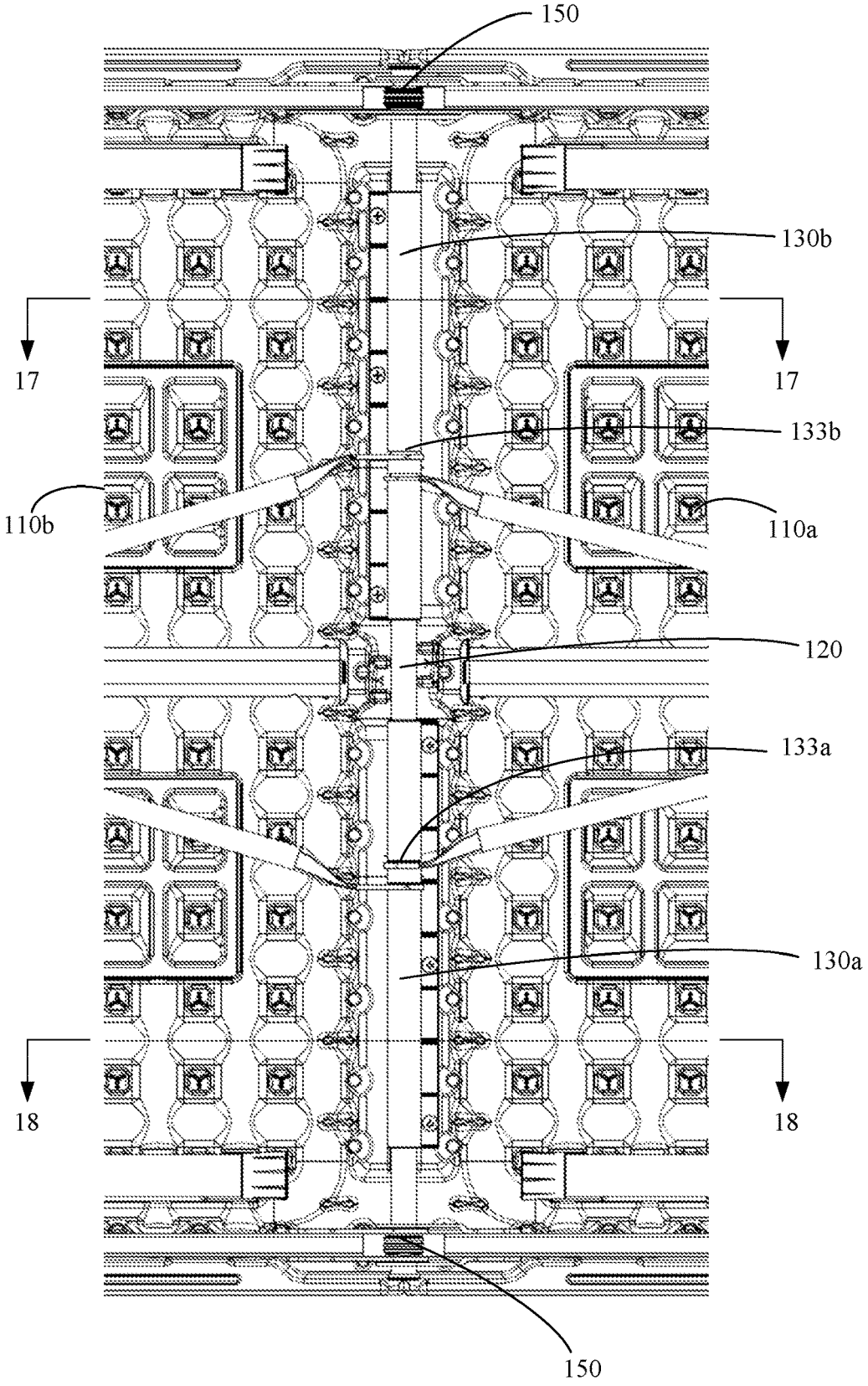
FIG. 16 is an enlarged view of a portion of FIG. 15.

Referring to FIGS. 2-4 and 7-8, in some exemplary embodiments, frame 101 includes one or more leg assemblies each pivotally connected to the first or second mounting assembly and rotatable with respect to the first or second mounting assembly between a use position and a storage position. For instance, in some exemplary embodiments, frame 101 includes first leg assembly 160*a* and second leg assembly 160*b*. The first and second leg assemblies can be, but do not necessarily have to be, identical or symmetric to each other. The first leg assembly is pivotally connected to the first mounting assembly and rotatable with respect to the first mounting assembly between a use position as illustrated in FIGS. 1-4 and a storage position as illustrated in FIGS. 7 and 15. Similarly, the second leg assembly is pivotally connected to the second mounting assembly and rotatable with respect to the second mounting assembly between a use position and a storage position. When in the use positions, the first and second leg assemblies support the first unit (e.g., the first mounting assembly together with the first panel) and the second unit (e.g., the second mounting assembly together with the second panel). When in the storage positions, the first leg assembly is folded onto the first unit and the second leg assembly is folded onto the second unit.

In some exemplary embodiments, frame 101 includes one or more supporting assemblies configured to control the rotation (e.g., folding and unfolding) of the one or more leg assemblies with respect to the first or second unit, and/or to stabilize the one or more leg assemblies when in the use positions. For instance, in some exemplary embodiments, frame 101 includes first supporting assembly 170*a* and second supporting assembly 170*b*. The first supporting assembly is pivotally connected to the shaft and first leg assembly, and configured to control the rotation of the first leg assembly with respect to the first mounting assembly. When the foldable table is in use, the first supporting assembly holds the first leg assembly in its use position and prevents the first leg assembly from rotating with respect to the first mounting assembly. Similarly, the second supporting assembly is pivotally connected to the shaft and second leg assembly, and configured to control rotation of the second leg assembly with respect to the second mounting assembly. When the foldable table is in use, the second supporting assembly holds the second leg assembly in its use position and prevents the second leg assembly from rotating with respect to the second mounting assembly. The first and second supporting assemblies can be, but do not necessarily have to be, identical or symmetric to each other.

In some exemplary embodiments, the first or second supporting assembly includes a first supporting member such as first supporting member 171, one or more second supporting member such as second supporting member 172, and a controller such as controller 180. The first supporting member has an end portion pivotally connected to the first or second leg assembly, for instance, by a bracket or the like. In some exemplary embodiments, the first supporting member is pivotally connected to a lateral bar of the first or second leg assembly. The controller is disposed at the first supporting member and selectively movable along a length direction of the first supporting member. The second supporting member has one end portion fixedly connected to the controller, for instance, by welding, adhesive or fastener, and the other end portion rotatably connected to the shaft, for instance, sleeved on the shaft through a hole formed on the other end portion of the second supporting member. As such, while the controller moves along the length direction of the first supporting member, the first and second supporting members move toward or away from each other, resulting in shortening or lengthening the length of the supporting assembly. Moreover, while moving toward or away from each other, the first supporting member and second supporting members also rotates, thereby allowing the first or second leg assembly to rotate between the use and storage positions. In some exemplary embodiments, the first or second supporting assembly includes a pair of second supporting members, one on each side of the control.

In some exemplary embodiments, when the table is folded, the first and second leg assemblies as well as the first and second supporting assemblies are sandwiched between the first and second panels. In some exemplary embodiments, the first and second panels are substantially the same in size, thereby allowing the foldable table to be folded generally in half.

Referring to FIGS. 2-8, in some exemplary embodiments, frame 101 includes one or more connectors for connecting the first panel and/or second panel with the shaft. For instance, in some exemplary embodiments, frame 101 includes first connector 130*a* for connecting the first panel with the shaft and/or second connector 130*b* for connecting the second panel with the shaft. The first connector is either fixedly or rotatable connected to the shaft, and is fixedly connected to the first panel. The second connector is rotatably connected to the shaft but fixedly connected to the second panel. In some exemplary embodiments, the first or second connector is sleeved on the shaft, for instance, through a hole formed in the first or second connector. The first and second connectors can be but do not necessarily have to be identical. In some exemplary embodiments, the first and second connectors are identical but disposed on the shaft asymmetrically.

In some exemplary embodiments, first connector 130*a* or second connector 130*b* is disposed at or connected to the shaft. For instance, in some exemplary embodiments, first connector 130*a* or second connector 130*b* is sleeved on the shaft, for instance, through a hole formed on the first or second shaft. The hole formed on the first connector can be either circular or non-circular. For instance, in some exemplary embodiment, the first connector is formed with a circular hole that allows the first connector to rotate around the shaft before it is connected to the first panel. In some exemplary embodiments, the first connector is formed with a non-circular hole that mates with the non-circular portion of the shaft such that the first connector cannot rotate around the shaft even before it is connected to the first panel. The hole formed on the second connector is generally circular such that the second connector can rotate around the shaft.

In some exemplary embodiments, the first or second connector includes a portion for fixedly connecting the first or second connector with the first or second panel. For instance, in some exemplary embodiments, first connector 130*a* includes first portion 131*a* for fixedly connecting the first connector with the first panel, for instance, by one or more fasteners, adhesives or the like. Similarly, second connector 130*b* includes second portion 131*b* for fixedly connecting the second connector with the second panel.

Figure 17:
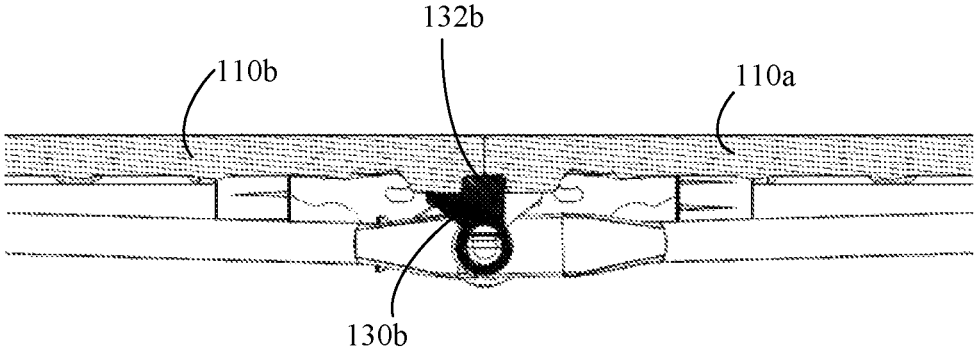
FIG. 17 is a cross-sectional view taken along line 17-17 in FIG. 16 illustrating some exemplary components of the exemplary foldable table in a first state in accordance with some exemplary embodiments of the present disclosure.
Figure 18:
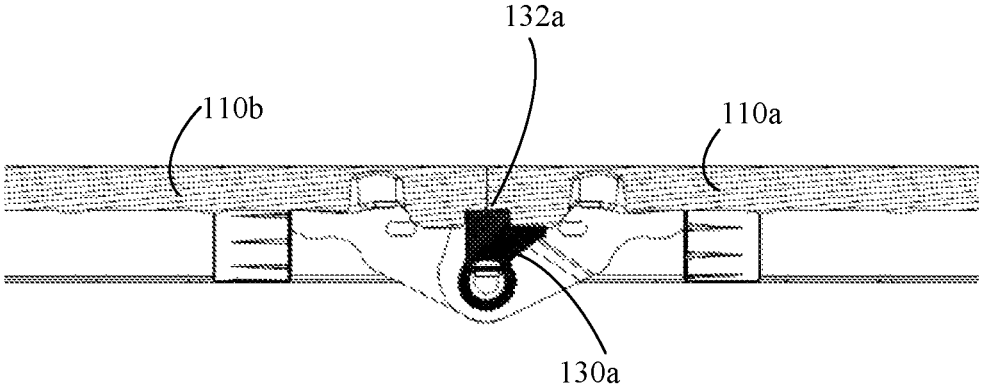
FIG. 18 is a cross-sectional view taken along line 18-18 in FIG. 16 illustrating some exemplary components of the exemplary foldable table in a first state in accordance with some exemplary embodiments of the present disclosure.
Figure 19:
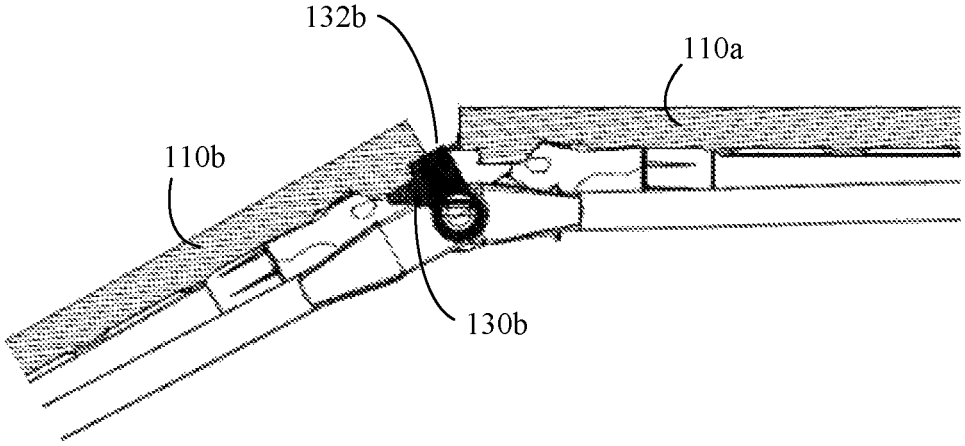
FIG. 19 is a cross-sectional view illustrating the components of FIG. 17 in a second state in accordance with some exemplary embodiments of the present disclosure.
Figure 20:
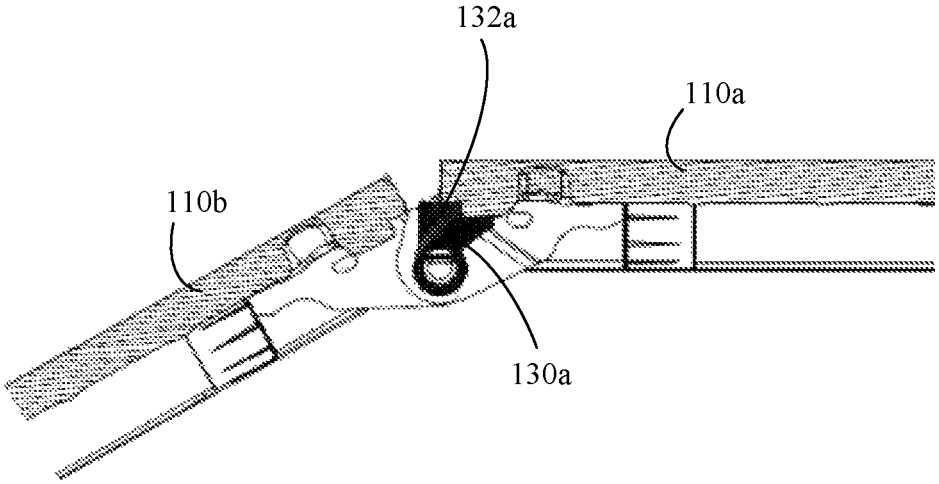
FIG. 20 is a cross-sectional view illustrating the components of FIG. 18 in a second state in accordance with some exemplary embodiments of the present disclosure.
Figure 21:
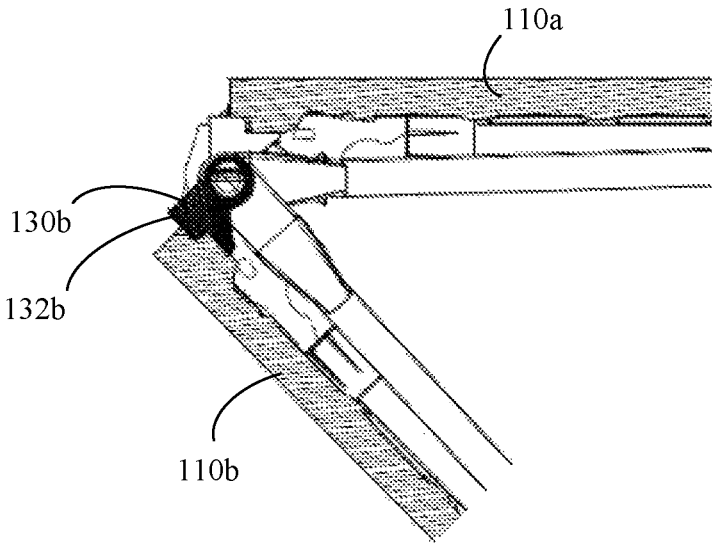
FIG. 21 is a cross-sectional view illustrating the components of FIG. 17 in a third state in accordance with some exemplary embodiments of the present disclosure.
Figure 22:
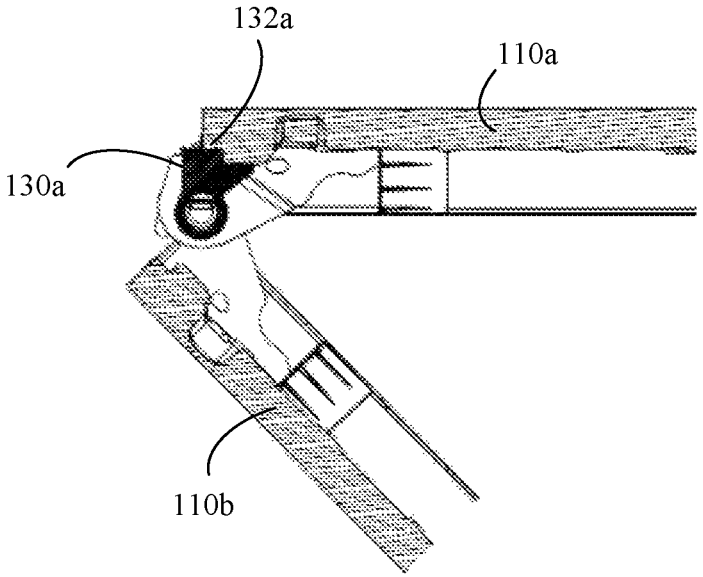
FIG. 22 is a cross-sectional view illustrating the components of FIG. 18 in a third state in accordance with some exemplary embodiments of the present disclosure.

In some exemplary embodiments, the first or second connector includes a surface configured to remaining in contact with the proximal side of the first or second panel, for abutting upwardly against the proximal sides of the first and second panels when the foldable structure is unfolded, or any combination thereof. For instance, in some exemplary embodiments, first connector 130*a* includes first surface 132*a* that remains in contact with the proximal side of the first panel as illustrated in FIGS. 18, 20 and 22 regardless of the state of the foldable table. When the foldable table is unfolded, first surface 132*a* abuts upwardly against the proximal sides of the first and second panels as illustrated in FIG. 18, and thus helps to level the first and second panels, e.g., help to support the first and second panels and/or prevent the proximal sides of the first and second panels from warping, sagging, dislocation or misalignment. Similarly, in some exemplary embodiments, second connector 130*b* includes second surface 132*b* that remains in contact with the proximal side of the second panel as illustrated in FIGS. 17, 19 and 21 regardless of the state of the foldable table. When the foldable table is unfolded, second surface 132*b* abuts upwardly against the proximal sides of the first and second panels as illustrated in FIG. 17, and thus helps to level the first and second panels, e.g., help to support the first and second panels and/or prevent the proximal sides of the first and second panels from warping, sagging, dislocation or misalignment.

In some exemplary embodiments, the first surface of the first connector is substantially flat and parallel to the upper surface of the first panel. Similarly, in some exemplary embodiments, the second surface of the second panel is substantially flat and parallel to the upper surface of the second panel. The first surface of the first connector and the second surface of the second connector can be, but do not necessarily have to be, leveled or aligned with each other in the height direction or any other direction of the foldable table. In some exemplary embodiments, the first surface of the first connector and the second surface of the second connector are substantially leveled with each other in the height direction of the foldable table when the foldable table is unfolded. In some exemplary embodiments, the first surface of the first connector or the second surface of the second connector is above the upper surface of the shaft. In some exemplary embodiments, the first and second panels are configured with one or more recesses, depressions, protrusions, steps, or any combination thereof at their proximal sides to accommodate the shaft, first connector and/or second connector.

In some exemplary embodiments, the first or second connector includes at least one slot configured to receive an end portion of second supporting member 172 of the first or second supporting assembly. For instance, in the illustrated embodiment, first connector 130*a* includes two slots 133*a*, one for receiving an end portion of second supporting member 172 of first supporting assembly 170*a* and the other for receiving an end portion of second supporting member 172 of second supporting assembly 170*b*. Second connector 130*a* includes two slots 133*b*, one for receiving an end portion of second supporting member 172 of first supporting assembly 170*a* and the other for receiving an end portion of second supporting member 172 of second supporting assembly 170*b*. However, the present disclosure is not limited thereto. For instance, the first or second connector can include a single slot to receive an end portion of second supporting member 172 of first supporting assembly 170*a* as well as an end portion of second supporting member 172 of second supporting assembly 170*b*. In some exemplary embodiments, the slot of the first or second connector is sized to prevent the end portion of the second supporting member from moving along the length direction of the shaft. This helps to smooth the folding and unfolding processes of the first or second leg assembly and enhance the stability of the foldable table.

The first or second connector can have any suitable length along a length direction of the shaft. For instance, in some exemplary embodiments, the first or second connector is elongated along the length direction of the shaft as illustrated in FIGS. 4 and 7. In some exemplary embodiments, the first or second connector is not elongated along the length direction of the shaft as illustrated in FIGS. 24 and 25. In some exemplary embodiments, the first or second connector has a length that is between the first or second connector illustrated in FIGS. 4 and 7 and the first or second connector illustrated in FIGS. 24 and 25.

Referring to FIGS. 26-31, in some exemplary embodiments, controller 180 includes a housing, such as housing 181, for fixedly connecting the controller with one or more second supporting members of the first or second supporting assembly. Controller 180 also includes a socket, such as socket 182, coupled with the housing. For instance, in some exemplary embodiments, socket 182 is snapped fitted and fastened with housing 181 through one or more cantilever beam with a hook 183 at its tip. However, the present disclosure is not limited thereof. The housing and socket can be coupled by fasteners, adhesives or other suitable methods. The housing and socket can also be formed as a unitary piece. The housing and socket coupled or formed together is referred herein as a body of the controller, which is sleeved on first supporting member 171.

In some exemplary embodiments, controller 180 includes a casing such as casing 184 integrally formed (e.g., by molding) or coupled (e.g., glued or fastened) with a side wall of the housing or socket. Controller 180 also includes a lever (or button) such as lever 185, a pin such as pin 186 and/or an elastic member such as elastic member 187. The lever is pivotally coupled with the casing. The pin is integrally formed or coupled with the level and disposed in the casing with a free end toward the interior of the housing or socket. The clastic member is disposed in the casing and has one end abutting the bottom of the casing and another end abutting the lever. The pin and elastic member are disposed at opposite sides of the pivotal point at which the lever is connected with the casing. Thus, when a hole such as hole 173 of the first supporting member is aligned with the controller, the elastic member pushes the free end of the pin into the hole of the first supporting member, thereby restricting the body from moving along the first supporting member, and accordingly restricting the controller and thus the second supporting member from moving along the first supporting member. Pressing the elastic member side of the lever toward the body will remove the free end of the pin from the hole of the first supporting member, thereby disengaging the body from the first supporting member and thus allowing the controller to move along the first supporting member.

In some exemplary embodiments, controller 180 is configured to be a slider or to include a slider similar to those disclosed in U.S. patent application Ser. Nos. 16/838,939, 16/838,944 and 16/838,947, the disclosure of each application is incorporated herein for all purposes by reference in its entirety.

In some exemplary embodiments, first supporting member 171 includes a stopper such as stopper 174. The stopper is disposed at an end portion of the first supporting member that is adjacent to the second support member, and configured to prevent complete disengagement of controller 180 from the first supporting member. For instance, in an exemplary embodiment, the stopper prevents the body of the controller from sliding off the first supporting member. In some exemplary embodiments, the stopper is coupled with the end portion of the first supporting member by press fitting, snap fitting, a fastener, or the like.

The foldable frame and table of the present disclosure are easy to fold and unfold. When folded, they are more convenient to carry around. When unfolded and in use, the shaft, first connector and/or second connector help to support the first and second panels and/or prevent the proximal sides of the first and second panels from warping, sagging, dislocation or misalignment. As a result, the first and second panels can be leveled to eliminate any height difference between the first and second panels. This not only provides the aesthetic appearance but also ensures the stability of the table. Moreover, the coupler, operated by gravity, automatically locks the mounting assemblies when the table is in use, and thus improves the safety and stability of the table. In addition, the leg assemblies can be folded or unfolded by the controller, thereby further improves the safety and stability of the table.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A foldable structure comprising:

a shaft elongated in a first direction and comprising at least one non-circular portion;

a first mounting assembly having a proximal side fixedly connected to the shaft to restrict rotation of the first mounting assembly relative to the shaft;

a second mounting assembly having a proximal side rotatably connected to the shaft to allow rotation of the second mounting assembly relative to the shaft;

a first panel fixedly connected to the first mounting assembly; and a second panel fixedly connected to the second mounting assembly, wherein an upper surface of the at least one non-circular portion of the shaft (i) remains in direct contact with a proximal side of the first panel whether the foldable structure is folded or unfolded, and (ii) when the foldable structure is unfolded, is in direct contact with a proximal side of the second panel and abuts upwardly against the proximal sides of the first and second panels, thereby helping to level the first and second panels.

2. The foldable structure of claim 1, wherein the at least one non-circular portion of the shaft has a substantially "D"-shaped cross section.

3. The foldable structure of claim 1, wherein the upper surface of the at least one non-circular portion of the shaft is substantially flat, and substantially parallel to an upper surface of the first panel.

4. The foldable structure of claim 1, wherein the shaft is non-circular along substantially an entire length of the shaft.

5. The foldable structure of claim 1, wherein:

the at least one non-circular portion comprises a non-circular end portion of the shaft;

the first mounting assembly comprises a first mounting member, wherein a proximal end portion of the first mounting member comprises a non-circular hole to receive the non-circular end portion of the shaft, wherein the non-circular hole of the first mounting member is sized and shaped corresponding to the non-circular end portion of the shaft to restrict the first mounting assembly together with the first panel from rotating relative to the shaft; and the second mounting assembly comprises a second mounting member, wherein a proximal end portion of the second mounting member comprises a substantially round hole to receive the non-circular end portion of the shaft and to allow the second mounting assembly together with the second panel to rotate relative to the shaft.

6. The foldable structure of claim 5, wherein:

the proximal end portion of the first mounting member includes a first lug integrally formed or coupled with the first mounting member; and the proximal end portion of the second mounting member includes a second lug integrally formed or coupled with the second mounting member.

7. The foldable structure of claim 5, further comprising:

a coupler disposed at the end portion of the shaft and movable relative to the shaft in a height direction of the foldable structure to automatically engage the second mounting member with the first mounting member when the foldable structure is unfolded and in use, thereby preventing accidental folding of the second mounting assembly relative to the first mounting assembly.

8. The foldable structure of claim 7, wherein:

the proximal end portion of the first mounting member comprises a first slot;

the proximal end portion of the second mounting member comprises a second slot;

the first and second slots are aligned with each other in a height direction of the foldable structure when the foldable structure is unfolded;

at least one of the first and second slots has a closed bottom and an open top; and the coupler comprises a first coupling piece with a third slot to receive the shaft and a second coupling piece integrally formed or coupled with the first coupling piece, wherein the third slot has a closed bottom and a closed top, with a dimension in the height direction of the foldable structure larger than the shaft to allow the first coupling piece to move relative to the shaft in the height direction of the foldable structure, thereby selectively disposing the second coupling piece in the first and second slots to lock the first and second mounting members with each other or removing the second coupling piece from the at least one of the first and second slots to unlock the first and second mounting members from each other.

9. The foldable structure of claim 1, further comprising:

a first connector connected to the shaft and fixedly connected to the proximal side of the first panel;

a second connector rotatably connected to the shaft and fixedly connected to the proximal side of the second panel; or both.

10. The foldable structure of claim 9, wherein the first or second connector is sleeved on the shaft.

11. The foldable structure of claim 9, wherein the first or second connector is elongated along a length direction of the shaft.

12. The foldable structure of claim 9, wherein:

the first connector comprising a first surface that remains in contact with the proximal side of the first panel, and when the foldable structure is unfolded, abuts upwardly against the proximal sides of the first and second panels, thereby helping to level the first and second panels;

the second connector comprising a second surface that remains in contact with the proximal side of the second panel, and when the foldable structure is unfolded, abuts upwardly against the proximal sides of the first and second panels, thereby helping to level the first and second panels; or both.

13. The foldable structure of claim 12, wherein:

the first surface is substantially flat and parallel to an upper surface of the first panel;

the second surface is substantially flat and parallel to an upper surface of the second panel; or both.

14. The foldable structure of claim 13, wherein the first surface of the first connector and the second surface of the second connector are substantially leveled with each other when the foldable structure is unfolded.

15. The foldable structure of claim 1, further comprising:

a first leg assembly pivotally connected to the first mounting assembly;

a second leg assembly pivotally connected to the second mounting assembly;

a first supporting assembly to control rotation of the first leg assembly; and a second supporting assembly to control rotation of the second leg assembly, wherein the first or second supporting assembly comprises:

a first supporting member pivotally connected to the first or second leg assembly;

a controller coupled with the first supporting member and selectively movable along the first supporting member; and one or more second supporting members, each having a first end portion fixedly connected to the controller and a second end portion pivotally connected to the shaft.

16. The foldable structure of claim 15, further comprising:

a first connector connected to the shaft and fixedly connected to the proximal side of the first panel; and a second connector rotatably connected to the shaft and fixedly connected to the proximal side of the second panel;

wherein the first or second connector comprises at least one slot to receive the second end portion of each of the one or more second supporting members.

17. A foldable structure comprising:

a shaft elongated in a first direction;

a first mounting assembly having a proximal side fixedly connected to the shaft to restrict rotation of the first mounting assembly relative to the shaft;

a second mounting assembly having a proximal side rotatably connected to the shaft to allow rotation of the second mounting assembly relative to the shaft;

a first panel fixedly connected to the first mounting assembly;

a second panel fixedly connected to the second mounting assembly;

a first connector disposed at the shaft and fixedly connected to the first panel, wherein the first connector comprises a first surface that (i) remains in direct contact with a proximal side of the first panel whether the foldable structure is folded or unfolded, and (ii) when the foldable structure is unfolded, is in direct contact with a proximal side of the second panel and abuts upwardly against the proximal sides of the first and second panels, thereby helping to level the first and second panels; and a second connector disposed at the shaft and fixedly connected to the second panel, wherein the second connector is rotatable relative to the shaft and comprises a second surface that (i) remains in direct contact with the proximal side of the second panel whether the foldable structure is folded or unfolded, and (ii) when the foldable structure is unfolded, is in direct contact with the proximal side of the first panel and abuts upwardly against the proximal sides of the first and second panels, thereby helping to level the first and second panels.

18. The foldable structure of claim 17, wherein:

the first surface is substantially flat and parallel to an upper surface of the first panel;

the second surface is substantially flat and parallel to an upper surface of the second panel; or both.

19. The foldable structure of claim 17, wherein when the foldable structure is unfolded and in use, the first or second surface is disposed above the shaft and aligned with the shaft in a height direction of the foldable structure.

* * * * *